US011517920B2

(12) United States Patent
Kato et al.

(10) Patent No.: US 11,517,920 B2
(45) Date of Patent: Dec. 6, 2022

(54) COATING NOZZLE

(71) Applicants: Chie Kato, Toyota (JP); Tomoaki Katsuno, Toyota (JP)

(72) Inventors: Chie Kato, Toyota (JP); Tomoaki Katsuno, Toyota (JP)

(73) Assignee: AISIN KAKO KABUSHIKI KAISHA, Toyota (JP)

( * ) Notice: Subject to any disclaimer, the term of this patent is extended or adjusted under 35 U.S.C. 154(b) by 119 days.

(21) Appl. No.: 16/448,738

(22) Filed: Jun. 21, 2019

(65) Prior Publication Data

US 2019/0388908 A1 Dec. 26, 2019

(30) Foreign Application Priority Data

Jun. 22, 2018 (JP) ..... JP2018-118713

(51) Int. Cl.
*B05B 1/04* (2006.01)

(52) U.S. Cl.
CPC ..... *B05B 1/044* (2013.01)

(58) Field of Classification Search
CPC ... B05B 1/044; B05B 13/0431; B05C 5/0212; B05C 5/0254
USPC ..... 239/597
See application file for complete search history.

(56) References Cited

U.S. PATENT DOCUMENTS 873,301 A * 12/1907 Cummings et al. .... B05B 1/044 239/592
1,186,117 A * 6/1916 Moe ..... B05B 1/044 239/592
2013/0119165 A1* 5/2013 Tomita ..... B05B 1/14 239/567
2014/0231552 A1* 8/2014 Katsuno ..... B05C 5/0254 239/597

FOREIGN PATENT DOCUMENTS

JP 11-179243 A 7/1999
JP 2012-011284 A 1/2012
JP 2014-155904 A 8/2014
WO 2010073751 A1 7/2010

OTHER PUBLICATIONS

Communication dated Sep. 27, 2020, from the State Intellectual Property Office of the P.R.C in application No. 201910540202.8.

* cited by examiner

*Primary Examiner* — Qingzhang Zhou
(74) *Attorney, Agent, or Firm* — Sughrue Mion, PLLC

(57) ABSTRACT

A coating nozzle 10 contains an introduction passage 21, an expansion passage 22 and a slit passage 23. The introduction passage 21 introduces high viscosity paint P and the slit passage 23 discharges it. The expansion passage 22 communicating with the introduction passage 21 has a wider space than the introduction passage 21 and substantially sectored-trapezoidal shape. The slit passage 23 is a slit opening communicating with the bottom of the expansion passage 22. The slit passage 23 includes a slit inlet port 23*b*

(Continued)

on the bottom of the expansion passage 22 and a slit outlet port 23*a* with an arc shape on the other side of the inlet port 23*b*. This slit passage 23 has Lt/R×100=70-130% wherein the curvature radius of the arc of the outlet port 23*a* is R and the chord length Lt of the arc of the outlet port 23*a* is Lt.

6 Claims, 8 Drawing Sheets

COATING NOZZLE

IN CORPORATION BY REFERENCE

The present invention is based on Japanese Patent Application No. 2018-118713, filed on Jun. 22, 2018, the contents of which are hereby incorporated by reference.

TECHNICAL FIELD

The present invention relates to a coating nozzle that sprays high viscosity paint on an object to be coated. This coating nozzle for high viscosity paint is used in slit application for spraying high viscosity paint including damping coat used in vehicles such as cars. This coating nozzle is attached to the distal end of a coating gun to spray the high viscosity paint on a target surface. In particular, the present invention relates to the coating nozzle that enables the coat pattern width to be unaffected by discharge quantity, coating distance, and paint temperature.

BACKGROUND ART

Damping coat for damping and soundproof is laid on the floor of vehicles including cars. The damping coat, which includes mainly acrylic resin and inorganic particles and is sprayed on car bodies, has increased its use instead of conventional pasting damping sheets, which is composed of asphalt with large specific gravity. The application of high viscosity paint for damping has expanded its emphasis in automation using a coating robot that enables process time to be shortened. For example, Japanese Unexamined Patent Application Publication Nos. 2014-155904 (JP-A-2014-155904), 2012-11284 (JP-A-2012-11284), and H11-179243 (JP-A-11-179243) disclose such application systems. As show in JP-A-2014-155904, JP-A-2012-11284, and JP-A-11-179243, a slit coating nozzle is attached to the distal end of a coating gun hold by a robot arm. The high viscosity paint is pumped to the slit coating nozzle. This slit coating nozzle discharge the high viscosity paint with pressure thinly. Thus, the slit coating nozzle sprays the high viscosity paint on a target including a car body.

The application system for automatically coating the high viscosity paint on a target including a car body is described below in accordance with JP-A-2014-155904 and JP-A-2012-11284. As shown in FIG. 8, a coating system 50 with a slit coating nozzle N includes a material container 51, a plunger pump 52, a filter 53, a regulator 54, a heat exchanger 55, a metering pump 56, a robot arm 57 and the slit coating nozzle N. The material container 51 contains the paint. The plunger pump 52 feds the paint with pressure in the coating system 50. The filter 53 removes foreign matters in the paint. The regulator 54 keeps the paint pressure suitably in the coating system 50. The heat exchanger 55 keeps the paint in the coating system 50 at a constant temperature. The metering pump 56 is driven by a servomotor and controls a quantity of the paint that is fed to the slit coating nozzle N. The robot arm 57 moves the coating nozzle N freely to a target, such as a car body.

For automatic coating using the robot arm 57, moving a coating gun G, which is hold by the robot arm 57 and has the slit coating nozzle N on the distal end of the gun G, allows coating position to be controlled. Adjusting the movement speed of the coating gun G or the coating nozzle N enables a coat thickness to be controlled.

The conventional slit coating nozzles disclosed in JP-A-2014-155904, JP-A-2012-11284, and JP-A-11-179243 cause the paint discharged from the nozzle with large discharge angle to spread as wider and farther as possible in the widthwise direction, thus enabling a coat pattern width to be wider than a discharge port width. Thus, the paint discharged from the nozzle spreads radially and widens to a target surface. Thus, the spread pattern of the paint, or the coat pattern width of the paint discharged from the nozzle is largely dependent on the pressure of the paint trough the discharge port. Thus, the coat pattern width is conventionally adjusted by varying the discharge quantity controlled by pressure. That is, the coat pattern width is conventionally controlled by discharge quantity.

Technical Problem

Unfortunately, for application using conventional slit coating nozzles disclosed in JP-A-2014-155904, JP-A-2012-11284, and JP-A-11-179243, a coat pattern width greatly varies in accordance with the discharge. Additionally, the coat pattern width greatly varies in accordance with the coating distance and the paint temperature (i.e., the material viscosity).

The nozzle disclosed in JP-A-2014-155904 has a small opening for providing a predetermined shear rate in low discharge area. Unfortunately, this small opening causes the paint trough the discharge port to have large pressure. Thus, the coat pattern width greatly varies in accordance with a variation in the coating distance and the paint viscosity (i.e., the paint temperature).

The nozzle disclosed in JP-A-2012-11284 has a small flattening. Such nozzles yield a predetermined shear rate and a flat coat surface. Unfortunately, the discharge quantity and the coating distance greatly affect the pattern width.

Thus, it is difficult for the application using conventional slit coating nozzles to make fine, or detailed adjustment of the discharge quantity, paint temperature and coating distance for yielding a desired pattern width. The application using conventional slit coating nozzles needs control with high precision.

That is, the application using the conventional slit coating nozzles needs the fine and precision control, or fine granularity control of the discharge quantity, coating distance and paint temperature to yield a desired pattern width. Application control technique with high precision is needed to provide a constant discharge quantity, coating distance and paint temperature. For the application using conventional slit coating nozzles, the fine or detailed control of the discharge quantity and paint temperature is needed. Additionally, machines with high precision and performance in the coating system 50 are needed to make a constant discharge quantity and paint temperature. Such machines include, for example, a metering pump for providing a steady discharge quantity and a heat exchanger for making a constant paint temperature, which is achieved by fine or detailed control. Additionally, the robot needs fine and precision control to make a constant coating distance. Thus, the robot needs complex program input as robot teaching.

In particular, damping coat for damping and soundproof of vehicles including cars is applied on not only even surface but also uneven surface, curved surface, and vertical surface. For the application of the high viscosity paint as the damping coat, the distance between the coating gun and the target surface varies. Thus, a higher coating distance dependence of the pattern width equates with a larger variation in the pattern width. High control technique with complex mechanisms having, for example, the detect of the shape of the target surface or the response of the robot arm is need to keep a fixed coating distance, that is, to move the coating gun to follow the shape of the target surface. Additionally, when the paint is applied on the curved surface, the discharge quantity is need to be linked with the acceleration deceleration of the robot arm to reflect the inertia of the robot arm. Thus, the control is complex.

It is an object of the present invention to provide a coating nozzle that enables a coat pattern width to be prevented from varying with the discharge quantity, coating distance, and paint temperature, and thus yields a fixed coat pattern width.

Solution to Problem

A coating nozzle according to one aspect of the present invention includes at least one member containing a slit passage that has a slit inlet port on an expansion passage and a slit outlet port on the opposite side of the slit inlet port. The slit outlet port has arc shape and discharges the paint. The expansion passage has a wider space volume than an introduction passage in which paint is introduced. The slit passage is a slit opening that communicates with the bottom of the expansion passage and is located in conformance with the widthwise direction of the bottom of the expansion passage. This slit passage has Lt/R×100(%)=70-130 wherein the curvature radius of the arc of the slit outlet port is R and the chord length of the arc of the slit outlet port is Lt.

The introduction passage is an inlet for introducing paint that has been pumped by pumping means including a metering pump. This introduction passage has, for example, a columnar shape extending in the longitudinal direction and communicates with an expansion passage, thus guiding the introduced paint to the expansion passage.

The expansion passage communicating with the introduction passage is wider in the widthwise direction than the opening of the lower end of the introduction passage and has a wider space volume than the introduction passage. The widthwise direction is a direction perpendicular to a coating direction (a traveling direction) of the coating nozzle. The expansion passage typically widens downward although the shape of the expansion passage is not limited. For example, the expansion passage may have a substantially trapezoidal shape in which the upper side is small and the lower side is large; that is, which widens from the top to the bottom. Alternatively, the expansion passage may have a substantially sectored trapezoidal shape in which the bottom side of the substantially trapezoidal shape is shaped in an arc extending widthwise. The coating direction above mentioned is a running direction or movement direction of the coating nozzle, which sprays the paint on a target surface. This coating direction is a coating line direction in which the paint discharged from the coating nozzle is applied on the target surface, or a work. The coating direction is equivalent to the thickness direction of the coating nozzle.

The slit passage communicates with the bottom of the expansion passage. This slit passage is an opening with a slit shape. The opening is narrower than the bottom end of the expansion passage in a direction perpendicular to the widthwise direction, i.e., a direction parallel to the coating direction or the thickness direction. The slit passage has a slit inlet port and a slit outlet port. The slit inlet port is on the expansion passage. That is, the slit inlet port is on the opposite side of the slit outlet port. The slit inlet port introduces the paint from the expansion passage. The slit outlet port has an arc shape and discharges the paint. Thus, the slit passage is an outlet for discharging the paint from the expansion passage through the slit outlet port.

This slit passage has Lt/R×100=70-130%, preferably, Lt/R×100=75-125%, more preferably, Lt/R×100=80-123% wherein the curvature radius of the arc of the slit outlet port is R and the chord length of the arc of the slit outlet port is Lt.

The slit outlet port may have a fixed curvature radius or variant curvature radiuses. When the slit outlet port has a gradual variation in the arc shape, that is, the arc of the slit outlet port has variant curvature radiuses, such as the arc of an ellipse, the average of the maximum and the minimum of the variant curvature radiuses is employed as a curvature radius R.

The chord length Lt of the arc of the slit outlet port is the length of a line segment across the both ends of the slit outlet port.

The term, "Lt/R×100=70-130%" refers to 70≤Lt/R×100 (%)≤130. That is, the ratio of the chord length Lt to the curvature radius R is 0.7 or more and 1.3 or less.

The opening of the slit outlet port is typically long in the widthwise direction perpendicular to the coating direction and narrow in a direction parallel to the coating direction. The direction parallel to the coating direction is a direction perpendicular to the widthwise direction.

The slit passage has the slit outlet port with an arc shape and a predetermined relationship between the curvature radius R and the chord length Lt. It is preferred that the slit passage have a substantially sectored trapezoid shape which widens from the slit inlet port to the slit outlet port. The substantially trapezoid shape means that the bottom side of the trapezoid, in which the top side is small and the bottom side is large, has an arc shape. When the bottom of the expansion passage has an arc shape, the slit passage is located along the arc shape of the expansion passage and has the slit inlet port with an arc shape extending in the widthwise direction. When the slit inlet port is shaped in the arc extending in the widthwise direction, the arc of the slit inlet port may be an arc of a perfect circle, in which the arc has a fixed curvature radius. Alternatively, the arc of the slit inlet port may be an arc of an ellipse, in which the arc gradually varies and has variant curvature radiuses. The central angle of the arc of the slit outlet port is not necessarily coincident with the central angle of the arc of the slit inlet port. The distance between the slit inlet port and the slit outlet port may be constant or inconstant.

Preferred paint that is applied through the coating nozzle is high viscosity paint with viscosity of 0.1 to 10 Pa·s/20° C. (shear rate: 9400 $s^{-1}$/20° C.). With the viscosity of the paint less than these values, the paint discharged from the slit outlet port of the coating nozzle would spread wider. This may cause a coat pattern width to greatly vary in accordance with the discharge quantity (i.e., pressure), paint temperature (i.e., viscosity or flow resistance), or coating distance (i.e., gun distance) even though the slit of the coating nozzle has a particular shape. With the viscosity of paint more than the values described above, the nozzle would be often clogged with the paint and thus the coat often has unevenness. The paint with too high viscosity would affect coat properties. The paint with high viscosity having 0.1 Pa·s/20° C. or more and 10 Pa·s/20° C. or less (shear rate: 9400 $s^{-1}$/20° C.) prevents the paint discharged from the slit outlet port from spreading and widening. Thus, the coat pattern width is independent of the discharge quantity (i.e., pressure), paint temperature (i.e., viscosity or flow resistance), or coating distance (i.e., gun distance). The coat pattern width is fixed. Additionally, the coat has evenness. The viscosity of the high viscosity paint is more preferably 0.5 Pa·s/20° C. or more and 5 Pa·s/20° C. or less (shear rate: 9400 $s^{-1}$/20° C.), still more preferably, 1 Pa·s/20° C. or more and 5 Pa·s/20° C. or less (shear rate: 9400 $s^{-1}$/20° C.).

Preferred discharge quantity of the paint is 3000 to 10000 cc/min. With the discharge quantity of the paint discharged from the slit outlet port less than these values, the coat would often have cracks. With the discharge quantity of the paint more than the values described above, the discharged paint would have large pressure and thus the coat on the surface would often have waves or wrinkles and be often uneven. The paint discharge quantity of 3000 to 10000 cc/min allows the coat to have no crack in the pattern and no wave or wrinkle, and to be flat. Thus, the coat has good appearance. More preferred discharge quantity is 6000 to 10000 cc/min.

A coating nozzle another aspect of the present invention is preferably formed of a plurality of the members that are assembled. In this coating nozzle, two members of the plurality of members define the slit passage.

Above-described "a plurality of members that are assembled" means that two or more members are assembled and joined with connecting means such as screws or bolts, and the members are separated by removing the screws, the bolts; that is, it means that a plurality of members is assembled using screws or bolts to allow the members to be separated by removing the screws or the bolts. A coating nozzle may be of a layered construction in which the members are aligned in the direction perpendicular to the widthwise direction, i.e., in the direction parallel to the coating direction or in the thickness direction of the coating nozzle. The layered construction may include two members, three members, or more.

Above-described "two members of a plurality of members define the slit passage" means that when two members form the coating nozzle, these two members define the slit passage. Additionally, above-described "two members of a plurality of members define the slit passage" means that when three or more members form the coating nozzle, two members out of three or more members define the slit passage. Thus, two members define the slit passage. This allows clogs in the slit passage to be easily eliminated by separating the two members, which define the slit passage.

A coating nozzle according to still another aspect of the present invention preferably has the slit passage that is offset from the vertical extension of the lower end of the introduction passage.

Above-described "the slit passage that is offset from the extension in which the lower end of the introduction passage" defines relative position between the introduction passage and the slit passage. This slit passage that is offset from the extension of the lower end of the introduction passage has a longer flow for the paint than the slit passage that would be located on the extension.

A coating nozzle according to still another aspect of the present invention preferably has 80° or more and 100° or less in central angle of the arc of the slit outlet port. The central angle, which is the open angle of the slit outlet port, is more preferably not less than 85° and not more than 95°.

A coating nozzle according to still another aspect of the present invention preferably has the slit passage that has a substantially sectored trapezoidal shape widening from the slit inlet port to the slit outlet port. Above-described "substantially sectored trapezoidal shape" is a shape that has arc, or curvature on the longer side (i.e., bottom side) of a pair of parallel and opposite sides (the upper side and the lower side) of the trapezoid, that is, a shape in which the longer straight side (i.e., bottom side) of a pair of parallel sides of the trapezoid is replaced with arcuate or curved side. The substantially sectored trapezoid is a shape that widens from the upper side to the lower side.

A coating nozzle according to still another aspect of the present invention preferably has the slit outlet port including a widthwise middle and both sides out of the widthwise middle. The widthwise middle has a fixed width in a direction perpendicular to the widthwise direction. Each side gradually decrease its width in a direction perpendicular to the widthwise direction toward the widthwise end of the slit outlet port.

Above-described "the width in a direction perpendicular to the widthwise direction" means the width in a direction parallel to the travelling direction of the coating nozzle, that is, the width in a thickness direction of the coating nozzle.

Above-described "The widthwise middle has a fixed width in a direction perpendicular to the widthwise direction. Each side gradually decrease its width in a direction perpendicular to the widthwise direction toward the widthwise end of the slit outlet port." means the widthwise middle of the slit outlet port has a fixed width and the remains ranging from each end of the widthwise middle to each widthwise end of the slit outlet port has variant widths in which the width gradually narrows from each end of the widthwise middle toward each widthwise end of the slit outlet port. In other words, the slit outlet port decreases in its width or its dimension in a direction perpendicular to the widthwise direction gradually towards the end of the slit outlet port except for the widthwise middle having a fixed width.

Advantageous Effects of the Invention

A coating nozzle according to one aspect of the present invention includes an expansion passage communicating with an introduction passage, which paint is introduced into. This expansion passage below the introduction passage is wider in the widthwise direction than the bottom end of the introduction passage and thus has a wider space volume than the introduction passage. The coating nozzle further includes a slit passage communicating with the expansion passage. The slit passage extending in the widthwise direction of the bottom of the expansion passage is an opening shaped in a slit. The slit passage has a slit inlet port on the bottom of the expansion passage and a slit outlet port opposite the slit inlet port. The slit outlet port discharging the paint has an arc shape extending widthwise. The slit passage has $Lt/R\times100=70\text{-}130\%$ wherein the curvature radius of the arc of the slit outlet port is R and the chord length of the arc of the slit outlet port is Lt.

According to the coating nozzle of one aspect of the present invention, the relationship between the curvature radius R of the arc of the slit outlet port and the chord length Lt of the arc of the slit outlet port is $Lt/R\times100(\%)=70\text{-}130$. This slit shape with $Lt/R\times100(\%)=70\text{-}130$ prevents the paint trough the slit outlet port from spreading and widening in the widthwise direction. That is, the slit shape with $Lt/R\times100(\%)=70\text{-}130$ eliminated or reduces widthwise spread of the paint that is perpendicularly discharged from the slit outlet port. The paint fails to spread radially and runs straight while running from the slit outlet port to the target surface. Consequently, a coat pattern width hardly varies even when coating distance (i.e., gun distance) varies.

As described above, the slit shape in which the relationship between the curvature radius R of the arc of the slit outlet port and the chord length Lt of the arc of the slit outlet port is $Lt/R\times100(\%)=70\text{-}130$ prevents the paint trough the slit outlet port from spreading and widening. Thus, the coat pattern width is hardly affected by the pressure and flow resistance of the paint trough the slit outlet port. The slit shape having Lt/R×100(%)=70-130 eliminates or reduces widthwise spread of the paint discharged from the slit outlet port. Thus, the coat pattern width hardly varies even when discharge quantity controlled by pressure varies. Additionally, the coat pattern width hardly varies even when paint temperature, or paint viscosity varies.

Thus, the coating nozzle according to one aspect of the present invention prevents the coat pattern width from varying with the discharge quantity, coating distance, and paint temperature. This yields a fixed coat pattern width.

A coating nozzle according to another aspect of the present invention is preferably formed of a plurality of the members that are assembled. In this coating nozzle, two members of the plurality of the members define the slit passage. If anything blocks the slit passage and affects the coating pattern accordingly, separating the two members allows it to be eliminated. Thus, the coating nozzle is easy to maintenance and stably yields a predetermined pattern width. For the coating nozzle formed of three or more members, it is only required that two members out of the three or more members are replaced by new ones if the members, specifically, their walls defining the slit passage are partially worn. Thus, the coating nozzle allows low cost maintenance. Only two members out of the three or more members may be composed of materials with high wear resistance while the remaining members may be composed of cheaper materials. This provides a low-cost coating nozzle.

A coating nozzle according to still another aspect of the present invention preferably has the slit passage that is offset from the vertical extension of the lower end of the introduction passage. Thus, this slit passage has a longer flow for the paint than the slit passage that would be located on the vertical extension of the lower end of the introduction passage. This reduces a variation in the flow velocity of the paint that flows from the introduction passage to the slit inlet port. Thus, this coating nozzle enables the coat to be flatter.

A coating nozzle according to still another aspect of the present invention preferably has the slit outlet port that has the arc with a central angle of 80-100°.

Too small central angle of the arc of the slit outlet port would fail to provide a predetermined coat pattern width, for example, a width of 50 to 100 mm. The coat may be often short of the pattern width. Too large central angle of the arc of the slit outlet port would cause the paint discharged from the slit outlet port to greatly spread and widen and thus the coat pattern often has cracks. Additionally, the coat pattern width largely would depend on the pressure, or the flow resistance of the paint through the slit outlet port. Thus, the coat pattern width may greatly vary in accordance with the discharge quantity, coating distance, and temperature of the paint.

The coating nozzle that has the slit outlet port in which the central angle of the arc is 80-100° allows the coat to have no pattern crack. Additionally, the coat pattern width hardly varies with the discharge quantity, coating distance and temperature of the paint. The coat has a predetermined pattern width more stably. More preferred central angle of the arc of the slit outlet port is 85-95°.

A coating nozzle according to still another aspect of the present invention preferably has the slit passage that widens from the slit inlet port to the slit outlet port in the widthwise direction. Thus, the paint spreads from the slit inlet port to the slit outlet port. This enables the coat to have a predetermined coat pattern width, for example, a width of 50-100 mm. Additionally, this coating nozzle provides thin coat and prevents an excessive coating.

A coating nozzle according to still another aspect of the present invention has the slit outlet in which the width of the widthwise middle is fixed and the width of each side out of the widthwise middle varies, specifically, gradually decreases gradually toward the end of the slit outlet. The width is in a direction perpendicular to the widthwise direction. Thus, the widthwise middle of the slit outlet port discharges the paint thickly, whereas the widthwise ends of the slit outlet port discharges the paint thinly. When the widthwise end of the coat lines overlap with each other, the overlap of the coat hardly thickens. In particular, the slit shape in which the relationship between the curvature radius R of the arc of the slit outlet port and the chord length Lt of the arc of the slit outlet port is Lt/R×100=70-130% prevents the paint through the slit outlet port from widening and spreading in the widthwise direction. This spreads the coat evenly on a target surface. When the widthwise end of the coat lines overlap with each other, the coat having the overlap is flat and uniform in thickness.

DESCRIPTION OF EMBODIMENTS

Embodiments of the present invention are described hereafter with reference to drawings. In the embodiments of the present invention, the same marks and the same codes mean the same or equivalent function parts. Thus, overlapped description thereof will be omitted here.

Figure 1:
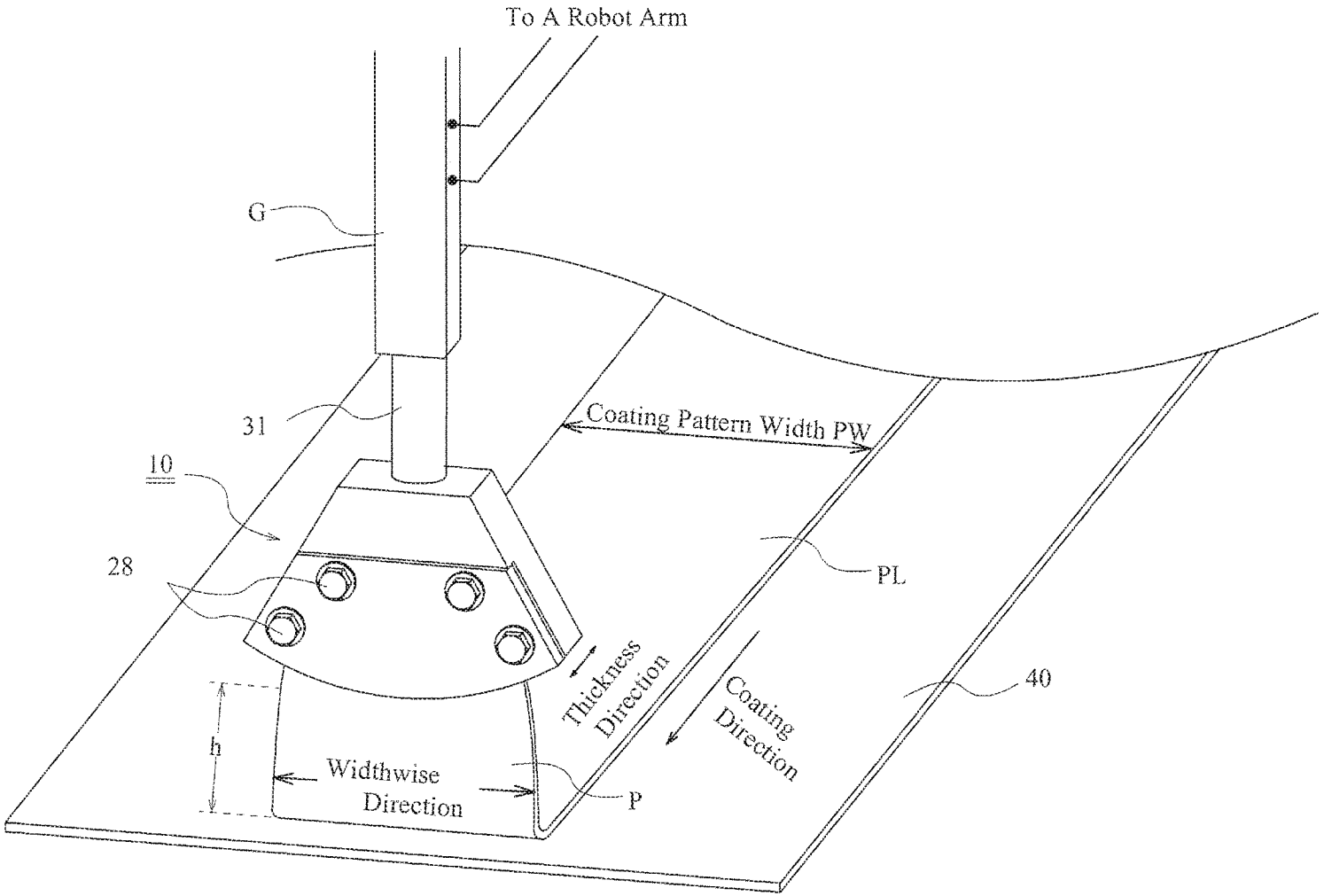
FIG. 1 is a perspective view illustrating the state where high viscosity paint is applied by the coating nozzle of a present embodiment.

A coating nozzle 10 according to a present embodiment includes a body 11, which includes an outer member 11A and an inner member 11B, and a lid 12. The coating nozzle 10 generally is formed into a substantially sectored trapezoidal shape that widens to the distal end side thereof, or the lower end side thereof. The outer member 11A of the body 11 generally is substantially sectored trapezoidal. This outer member 11A is thicker on the proximal end side (the upper side), which paint is introduced into, and thinner on the distal end side (the arc shape side). Thus, the outer member 11A is formed into an inverted-L shape in a cross-section. The inner member 11B of the body 11 generally is substantially sectored trapezoidal and planar. This inner member 11B is located on the lower side (i.e., the thinner side or the distal end side) of the outer member 11A. The lid 12 generally is substantially sectored trapezoidal. This lid 12 is located on one side of the inner member 11B. The one side of the inner member 11B is the opposite side of the outer member 11A. Thus, the lower side of the coating nozzle 10 has the inner member 11B between the outer member 11A and the lid 12. These outer member 11A, inner member 11B and lid 12 are integrally fixed with four embedded screws 28. The inner member 11B and the lid 12 are together attached to the lower and thinner part of the outer member 11A. Thus, the outer member 11A, the inner member 11B and the lid 12 are integrally fixed with four embedded screws 28. This fixed outer member 11A, inner member 11B and lid 12 generally is substantially sectored trapezoidal and has a thick-plated shape. As shown in a cross-sectional view of FIG. 4, the planer inner member 11B is attached to a recess part of the outer member 11A. The recess is on a thinner part in the outer member 11A having a step or unevenness. Additionally, the lid 12 is attached to the inner member 11B such that the lug part of the lid 12 is on the upper, left, and right part of the inner member 11B. The lug part of the lid 12 is a part except for a through hole 22 (described later) in the lid 12; that is, the lug part is the upper, left, and right part in the lid 12. The upper, left, and right part of the inner member 11B is a part except for a recess 22*c* (described later) in the inner member 11B. The lid 12 and the inner member 11B are put in the recess of the outer member 11A such that a part of the lid 12 protrudes from the body 11. Thus, the coating nozzle 10 has a surface with a step or unevenness on one side parallel to the travelling direction of the coating nozzle 10. In FIG. 1, two screws are on the upper left and right sides of the coating nozzle 10 and two other screws are on the lower left and right sides of the coating nozzle 10; that is, four embedded screws 28 are used in attachment. In FIG. 2 to FIG. 5, such embedded screws 28 are omitted.

The term, "substantially sectored trapezoidal" shape refers to a shape in which at least one side of a pair of parallel and opposed sides (i.e., the top side and the bottom side) of a trapezoid has an arc shape. The coating nozzle 10 of the present embodiment generally has a substantially sectored trapezoidal shape in which the longer side (i.e., the bottom side) of a pair of parallel and opposed sides of an isosceles trapezoid with a line symmetry is arcuate. The outer member 11A, the inner member 11B and the lid 12 each has generally a substantially sectored trapezoidal shape in which the longer side (i.e., the bottom side) of a pair of parallel and opposed sides of an isosceles trapezoid with a line symmetry is arcuate. The arc of the bottom of the coating nozzle 10 curves so as to protrude downward. The widthwise middle in the arc is the lowermost end.

Thus, the coating nozzle 10 is formed by assembling a plurality of the members that are the outer member 11A, the inner member 11B, and the lid 12, which are different each other. Attaching or detaching the embedded screws 28 to the coating nozzle 10 enables the coating nozzle 10 to be fixed or separated. When the coating nozzle 10 would be clogged with high viscosity paint P, separating and washing the coating nozzle 10 enables the clogging to be eliminated easily.

A coating nozzle 10, which is formed of the lid 12 and the body 11 with the outer member 11A and the inner member 11B, contains an introduction passage 21, an expansion passage 22 below the introduction passage 21, and a slit passage 23 below the expansion passage 22 as internal spaces or channels which the high viscosity paint P passes through. The introduction passage 21 in the proximal end of the body 11 introduces the high viscosity paint P. The slit passage 23 is located in one end of the thickness direction perpendicular to the widthwise direction of the coating nozzle 10, or one end of a direction parallel to the coating direction of the coating nozzle 10.

The introduction passage 21 is a space with a cylindrical shape in the widthwise middle of the proximal end of the outer member 11A constituting the body 11. This introduction passage 21 is joined to an introduction tube 31 that has a cylindrical shape and supplies the high viscosity paint P to the coating nozzle 10. Thus, the introduction passage 21 introduces the high viscosity paint P from the introduction tube 31. This introduction passage 21 is formed as a through hole that is in the widthwise middle of the proximal end of the outer member 11A and communicates with the expansion passage 22 below the outer member 11A. The introduction passage 21 has an internal thread 31*a* screwed on the inner circumferential surface thereof. This internal thread 31*a* is threadedly engaged with an external thread screwed on the outer peripheral surface of the introduction tube 31. This enables the introduction tube 31 to be attached to the proximal end of the outer member 11A of the body 11. The coating nozzle 10 is fixed to the distal end of the introduction tube 31.

Thus, the high viscosity paint P that is supplied trough the introduction tube 31 at a predetermined pressure is introduced into the introduction passage 21 of the coating nozzle 10.

The expansion passage 22 connected with the introduction passage 21 includes a recess 22*a* in the lower or the distal end of the outer member 11A, a through hole 22*b* in the widthwise middle of the inner member 11B, and a recess 22*c* in the inside of the lid 12. The recess 22*a* is substantially sectored trapezoidal. The through hole 22*b* facing the recess 22*a* is substantially sectored trapezoidal. The recess 22*c* facing the through hole 22*b* is substantially sectored trapezoidal in the lid 12 having a step. The expansion passage 22 is wider in the widthwise direction than the bottom end of the introduction passage 21 and widens to the lower, or the arcuate distal end of the coating nozzle 10. Thus, the expansion passage 22 is a space that is substantially sectored trapezoidal and is wider than the introduction passage 21. The coating nozzle 10 of the present embodiment generally has a substantially sectored trapezoidal shape in which the longer side (i.e., the bottom side) of a pair of parallel and opposed sides of an isosceles trapezoid with a line symmetry is arcuate as described. The expansion passage 22 also has a substantially sectored trapezoidal shape in which the longer side (i.e., the bottom side) of a pair of parallel and opposed sides of an isosceles trapezoid with a line symmetry is arcuate. The arc of the bottom of the coating nozzle 10 curves so as to protrude downward. The widthwise middle in the arc is the lowermost end.

The lid 12 and the inner member 11B define a slit inlet port 23*b* of the slit passage 23 that is much narrower than the expansion passage 22. The slit passage 23 below the expansion passage 22 is located along the arc shape of the through hole 22*b* of the inner member 11B and has a substantially sectored trapezoid.

This slit passage 23 has a slit outlet port 23*a* with a substantially arc and the slit inlet port 23*b* with a substantially arc. The slit outlet port 23*a* discharges the high viscosity paint P. The slit inlet port 23*b* is opposite the slit outlet port 23*a* and is a predetermined distance from the slit outlet port 23*a*. The slit inlet port 23*b* is on the expansion passage 22. The slit passage 23 widens or expands in the widthwise direction from the slit inlet port 23*b* to the slit outlet port 23*a* with an arc shape. This widening or expansion direction is equivalent to the extension of widening or expansion direction of the expansion passage 22 that widens or expands in the widthwise direction to the distal end side and is a substantially sectored trapezoidal. The slit outlet port 23*a* and the slit inlet port 23*b* both are shaped in an arc. Each arc curves so as to protrude downward. The widthwise middle in the arc is the lowermost end.

Thus, the slit passage 23 is defined by the inner member 11B of the body 11 and the lid 12, and is formed on the arc of the bottom of the coating nozzle 10, which is substantially sectored trapezoidal and includes the body 11 and the lid 12. This slit passage 23 is a slit opening elongated in the widthwise direction. Specifically, the slit passage 23 is below the arcuate bottom of the expansion passage 22 and in the one end of the thickness direction of the coating nozzle 10; that is, it is placed below the expansion passage 22 and near the lid 12. The slit passage 23 is located between the recess 22*c* inside of the lid 12 facing the inner member 11B and the arcuate lower end part of the inner member 11B. This slit passage 23 is an arcuate space that has a predetermined width and is in the arcuate distal end part of the coating nozzle 10. The slit outlet port 23*a* and the slit inlet port 23*b* are arcuate. Additionally, the slit passage 23 widens from the slit inlet port 23*b* to the slit outlet port 23*a*. Thus, the slit passage 23 generally is shaped in a substantially arc or a substantially sectored trapezoid, in which the parallel and opposed both sides (i.e., the upper side and the bottom side) of an isosceles trapezoid with a line symmetry is arcuate.

Figure 2:
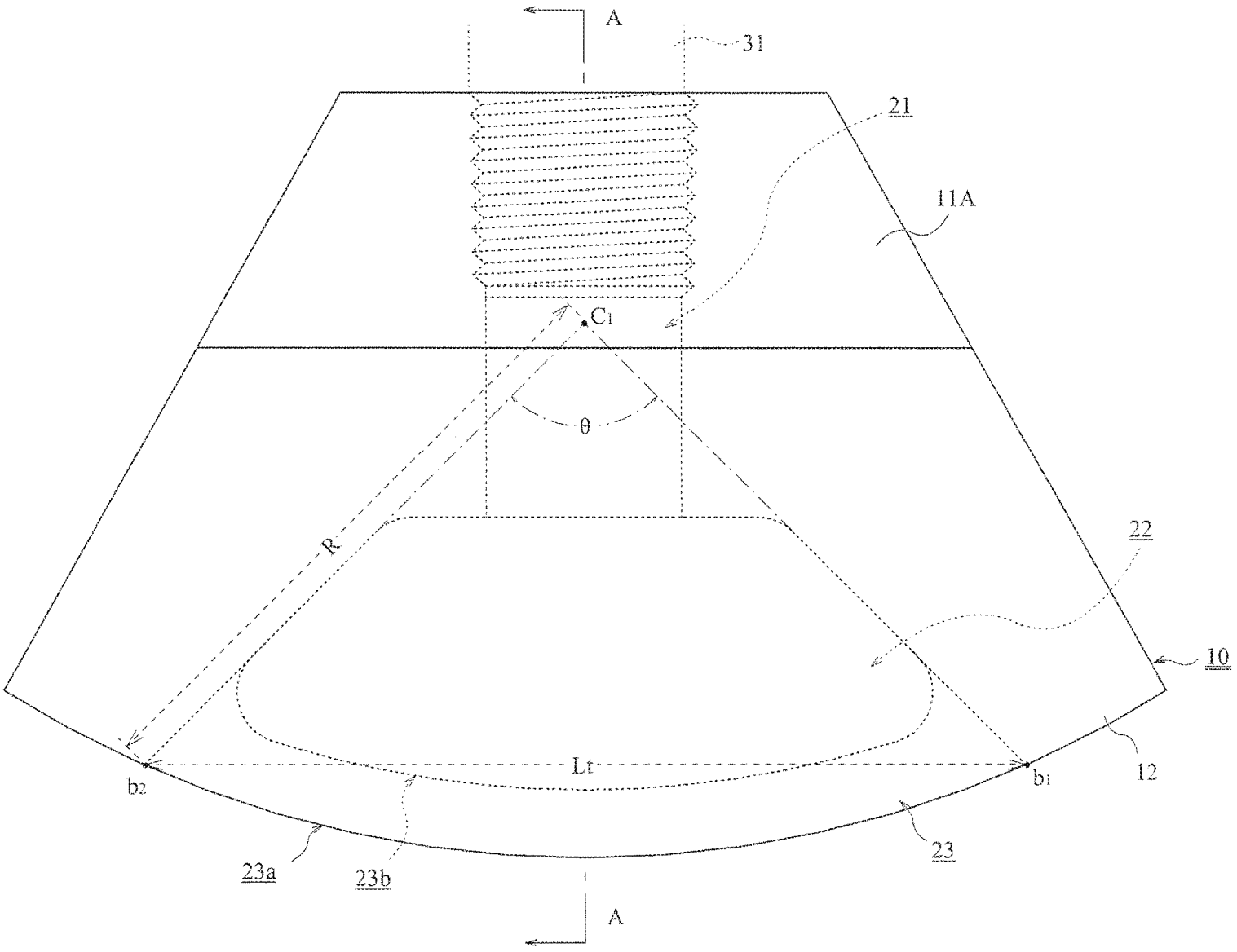
FIG. 2 is a plan view of the coating nozzle of the present embodiment.

As shown in FIG. 2, the curvature radius R of the arc $b_1b_2$ of the slit outlet port 23*a* is larger than the curvature radius of the middle of the slit inlet port 23*b* wherein the widthwise both ends of the slit outlet port 23*a* with arc-extended are $b_1$ and $b_2$. The slit passage 23 widens from the slit inlet port 23*b* to the slit outlet port 23*a*. In other words, the slit passage 23 narrows from the slit outlet port 23*a* to the slit inlet port 23*b* as it converges towards the curvature center $C_1$ of the arc $b_1b_2$ of the slit outlet port 23*a*. The slit outlet port 23*a* of the slit passage 23 spreads or widens at angle θ wherein the central angle of the arc $b_1b_2$ of the slit outlet port 23*a* is θ.

Thus, the coating nozzle 10 of the present embodiment includes the body 11 and the lid 12. The body 11 includes the inner member 11B and the outer member 11A. The inner member 11B and the outer member 11A generally are substantially sectored trapezoidal and contain the introduction passage 21 introducing the high viscosity paint P. The lid 12 generally is substantially sectored trapezoidal and is attached to the wider and arcuate side of the body 11. The inner wall of the body 11, which includes the outer member 11A and the inner member 11B, and the inner wall of the lid 12 define the expansion passage 22 below the introduction passage 21. This expansion passage 22 communicates with the introduction passage 21 and is wider in the widthwise direction than the bottom end of the introduction passage 21. The expansion passage 22 is substantially sectored trapezoidal and has a space that is wider than the introduction passage 21. Additionally, the inner member 11B of the body 11 and the lid 12 define the slit passage 23 below the arcuate side of the expansion passage 22. This slit passage 23 is a slit opening shaped in conformance with the arc of the body 11 and lid 12. The slit passage 23 has an arc shape and communicates with the expansion passage 22.

Figure 8:
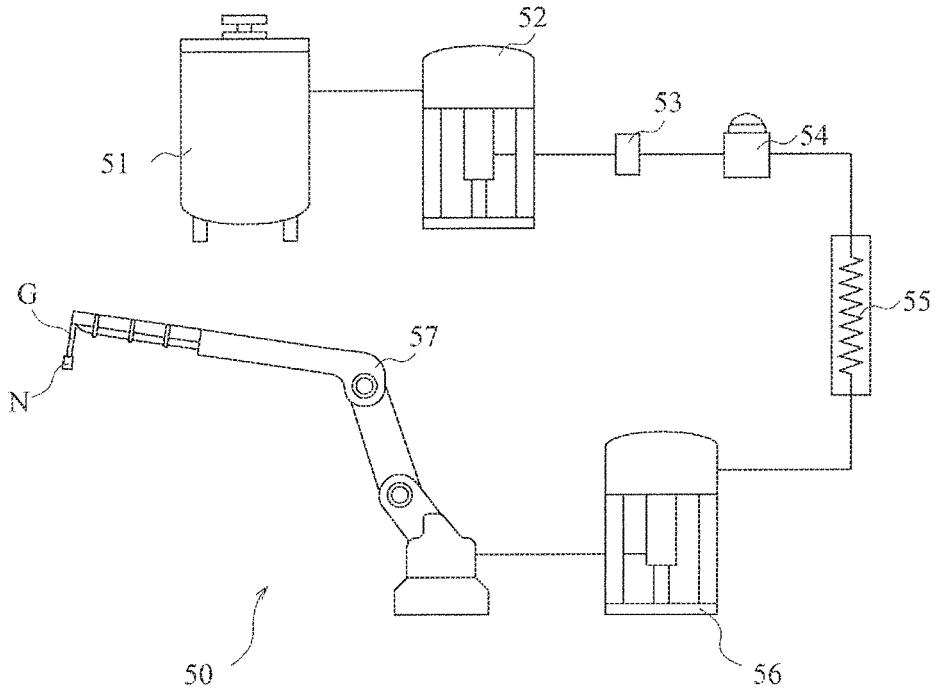
FIG. 8 is a schematic view illustrating a coating system including a slit coating nozzle.

Thus, according to this coating nozzle 10, the high viscosity paint P, which is fed from a coating gun G held by a robot arm 57 (referring to FIG. 8) to the introduction tube 31 at a predetermined pressure, is introduced into the introduction passage 21 and then the expansion passage 22.

The expansion passage 22 is wider in the widthwise direction than the lower end of the introduction passage 21 and has wider space than the introduction passage 21. On the distal end of the expansion passage 22, the inner member 11B of the body 11 and the lid 12 define the opened slit inlet port 23*b* of the slit passage 23, which is much narrower than the expansion passage 22. The bottom of the expansion passage 22 is sufficiently larger in the thickness direction than the slit inlet port 23*b*. In other words, the slit inlet port 23*b* is much narrower in the direction perpendicular to the widthwise direction of the slit inlet port 23*b*, or specifically in the thickness direction of the coating nozzle 10 than the bottom of the expansion passage 22.

The high viscosity paint P that is introduced into the expansion passage 22 from the introduction passage 21 widens widthwise as it flows to the distal end of the expansion passage 22. Thus, the high viscosity paint P flows into the slit inlet port 23*b* of the slit passage 23 while slowing down. The flow passage of the high viscosity paint P from the introduction passage 21 expands in the expansion passage 22, whereas the flow passage of the high viscosity paint P from the expansion passage 22 narrows in the slit passage 23, which discharges the high viscosity paint P. Thus, the high viscosity paint P from the introduction passage 21 stagnates temporarily in the expansion passage 22. This enables the inner pressure of the high viscosity paint P to be released in the expansion passage 22. Thus, the high viscosity paint P with homogenized inner pressure and viscosity flows into the slit inlet port 23*b* and then is discharged from the slit outlet port 23*a*. This prevents the unevenness of the coat PL and yields flat coat PL. When the high viscosity paint P from the introduction tube 31 has a variation in characteristics including pressure distribution, flow rate, and viscosity, such variations in the high viscosity paint P is reduced or eliminated through the expansion passage 22 and thus the coat PL is flat stably.

Figure 3:
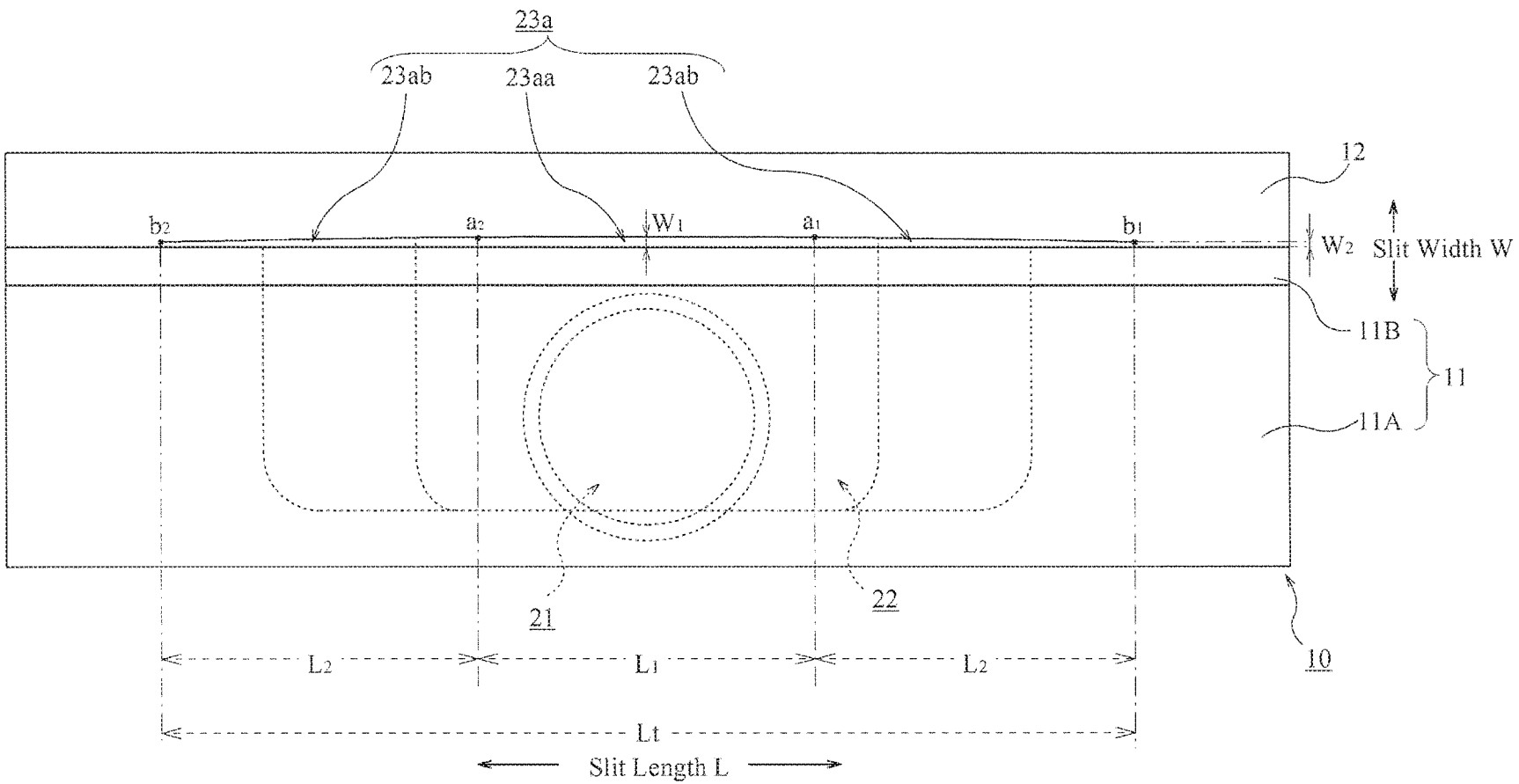
FIG. 3 is an elevation view from the outlet side of the coating nozzle of the present embodiment.
Figure 4:
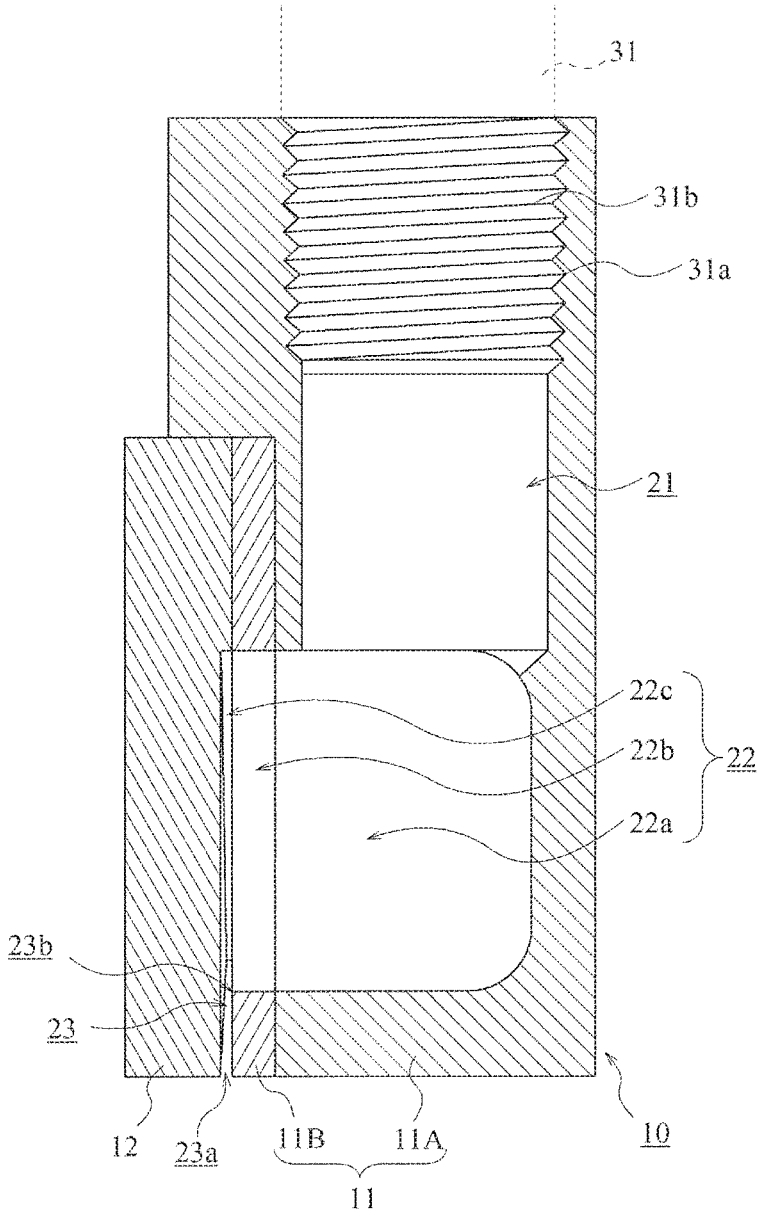
FIG. 4 is a cross-sectional view of the coating nozzle taken along the line A-A in FIG. 2

In the coating nozzle 10 of the present embodiment shown in FIG. 3 and FIG. 4, the slit passage 23 is not located on the vertical extension of the introduction passage 21 inside in the outer member 11A of the body 11. The slit passage 23 is out of the vertical extension of the introduction passage 21. The vertical extension is a longitudinal extension in which the lower end of the introduction passage 21 would be extended to the expansion passage 22 in the axial direction. In other words, the slit inlet port 23*b* on the arcuate side of the expansion passage 22 is displaced from the vertical direction of the introduction passage 21

This allows the high viscosity paint P from the introduction passage 21 to fail to flow vertically, or straight down to the slit inlet port 23*b* of the slit passage 23. The high viscosity paint P often flows down while varying in flow direction. In other words, the flow passage of the high viscosity paint P flowing from the introduction passage 21 to the slit passage 23 that is displaced from the longitudinal extension of the introduction passage 21 is longer than that of the high viscosity paint P flowing from the introduction passage 21 to the slit passage 23 that is placed on the longitudinal extension of the introduction passage 21. This allows the high viscosity paint P flowing from the introduction passage 21 to the slit passage 23 to have resistance. Thus, the high viscosity paint P flowing from the introduction passage 21 to the slit passage 23 that is outside of the vertical extension of the introduction passage 21 flows slower than the high viscosity paint P flowing from the introduction passage 21 to the slit passage 23 that is located on the vertical extension of the introduction passage 21. This reduces a variation in flow velocity distribution in the high viscosity paint P flowing from the introduction passage 21 to the slit passage 23 that is out of the vertical extension of the introduction passage 21. This allows the high viscosity paint P to have homogenized inner pressure and viscosity in the expansion passage 22. Even when the high viscosity paint P from the introduction tube 31 has a variation in characteristics including the pressure distribution, the flow rate and the viscosity, the coat PL has less unevenness and high flatness. Deceleration of the high viscosity paint P enables the high viscosity paint P discharged from the slit outlet port 23*a* to be prevented from widening and spreading in the widthwise direction.

In the coating nozzle 10 of the present embodiment, the widthwise both ends of the arc of the bottom of the expansion passage 22 with a substantially sectored trapezoidal shape, specifically, the widthwise both ends of the arc of the bottom side of the through hole 22*b*, which feeds the high viscosity paint P into the slit inlet port 23*b*, have no sharp edge but round or chamfering corner. In other words, the curvature radius of the arc of the slit inlet port 23*b* is not uniform but gradually varies. The space between the slit inlet port 23*b* and the slit outlet port 23*a* in the slit passage 23 is loner at the widthwise both ends.

Thus, the high viscosity paint P flowing through widthwise each end of the slit passage 23 has higher resistance and flows slower than the high viscosity paint P flowing through the widthwise middle of the slit passage 23. This allows the high viscosity paint P discharged from widthwise each end of the slit outlet port 23*a* to fail to spread and reach far. The high viscosity paint P hardly widens and spreads in the widthwise direction.

The slit outlet port 23*a* of the slit passage 23 according to the present embodiment, or the outlet port discharging the high viscosity paint P is shaped in such a manner that the opening of the widthwise middle is the largest and the opening outside of the widthwise middle decreases gradually toward the widthwise end $b_1$ and end $b_2$. The opening of the slit outlet port 23*a* is symmetrical in the widthwise direction. The symmetrical line (not shown) of the slit outlet port 23*a* corresponds to the symmetrical center line (not shown) of the lower end of the introduction passage 21.

A slit length Lt corresponds to a chord length that is a straight-line distance between the end $b_1$ and end $b_2$ of the slit outlet port 23*a* having an arc shape wherein the slit length L is the widthwise direction of the slit outlet port 23*a* and the a slit length Lt is the opening dimension, or specifically the length of the slit length L.

A middle part 23*aa*, which is the widthwise middle part of the slit outlet port 23*a* and corresponds to one-third of the slit length Lt, has a fixed slit width $W_1$. The slit width $W_1$ is the opening dimension, or specifically the width of a slit width W in a direction perpendicular to the slit length L (i.e., the width of a slit width W in the thickness direction perpendicular to the slit length L, or the slit width W in a direction parallel to the coating direction). Whereas, each end part 23*ab*, which is a side part of the middle part 23*aa* having a fixed slit width $W_1$, has variant opening dimensions of the slit width W. Each end part 23*ab* decrease its width or its opening dimension gradually toward the widthwise end $b_1$ or end $b_2$ of the slit outlet port 23*a*. Thus, the widthwise end $b_1$ and end $b_2$ of the slit outlet port 23*a* have a slit width $W_2$ ($W_1>W_2$) that is a minimum value of the slit width W.

As shown in FIG. 3, the slit outlet port 23*a* has a fixed width of the slit width W in the widthwise middle. The fixed width is a fixed interval between parallel and opposed sides extending in the widthwise direction. The part with a fixed width of the slit width W corresponds to one-third of the slit length Lt. This part with a fixed width of the slit width W is the middle part 23*aa*. In the middle part 23*aa*, the width of the slit width W is a slit width $W_1$ and the length of the slit length L is a slit length $L_1$. In FIG. 3, the widthwise one end of the middle part 23*aa* is $a_1$ and the other end of the middle part 23*aa* is $a_2$.

In the right and left sides in the widthwise direction of the slit outlet port 23*a*, or specifically in the outside of the middle part 23*aa*, one side that is one of the opposed sides extending in widthwise direction of the slit outlet port 23*a* and is closer to the lid 12 is diagonal. The other side that is closer to the inner member 11B is straight. The interval between the diagonal side that is closer to the lid 12 and the straight side that is closer to the inner member 11B increases gradually from the end $a_1$ and the end $a_2$ toward the end $b_1$ and the end $b_2$. This part with a variation in the width is the end part 23*ab*. The width of the slit width W of each end $b_2$ or end $b_1$ in the end part 23*ab* is the slit width $W_2$. The length of the slit length L of the end part 23*ab* is a slit length $L_2$. The slit width $W_1$ is a maximum width in the slit width W and the slit width $W_2$ is a minimum width in the slit width W.

The opening dimension of the slit length L is $Lt=L_1+2L_2$. The relationship between the slit length $L_1$ and the slit length $L_2$ is $L_1>L_2$ in the present embodiment. This allows the coat to have a uniform thickness without excessive coat when the lines of the coat PL overlap each other in the widthwise direction. As mentioned above, the slit length L is not the arc length of the slit outlet port 23*a* with an arc shape but the direct distance between the end $b_1$ and end $b_2$, or the chord length of the arc $b_1b_2$.

The slit outlet port 23*a* includes the middle part 23*aa* and the both ends part 23*ab*. The middle part 23*aa* is in the widthwise middle of the slit outlet port 23*a* and has a fixed slit width W. Each end part 23*ab* ranges from the widthwise side $a_1$ or side $a_2$ of the middle part 23*aa* to the widthwise end $b_1$ or end $b_2$ of the slit outlet port 23*a* and has a variation in the slit width W. The end part 23*ab* has the slit width W that gradually narrows down to the end $b_1$ or end $b_2$.

Consequently, the high viscosity paint P is discharged thickly from the widthwise middle part of the slit outlet port 23, which is the outlet port discharging the high viscosity paint P in the coating nozzle 10, while being discharged thinly from the widthwise both ends part of the slit outlet port 23 so that the high viscosity paint P gradually thins toward each end of the slit outlet port 23. That is, the widthwise middle part of the slit outlet port 23 discharges the high viscosity paint P with a fixed thickness while the widthwise both sides part of the slit outlet port 23 discharges the high viscosity paint P that thins gradually toward each end of the slit outlet port 23. This allows the overlap to create less perceptible ridge when the widthwise end of the next line of the coat PL overlaps with the widthwise end of the previous line of the coat PL so that the end parts having a variation in the thickness of the high viscosity paint P overlap each other. The overlap is prevented from being thicker than the middle with a fixed thickness. Thus, the coat PL is to be flat, and to have less unevenness and a uniform thickness. In particular, even when the lines of the coat overlap each other on the lug of the surface 40 with unevenness, the overlap has less increase in the thickness. Thus, the overlap hardly interferes with other component parts. The slit width $W_2$ is preferably 0.4 to 0.6 times as large as the slit width $W_1$. This minimizes the difference in the coat thickness between the overlap and non-overlap, enabling the coat to have high flatness.

The inventors made some prototypes of coating nozzles with differences in shapes or structures. The inventors experimented on the coating of the high viscosity paint P by using these coating nozzles to find a coating nozzle that prevents the coat pattern width PW from varying with the gun distance, discharge quantity and temperature. The inventors have noted the spread and widening of the high viscosity paint P discharged from the slit outlet port 23*a* of the slit passage 23, which widens in the widthwise direction from the slit inlet port 23*b* with an arc shape to the slit outlet port 23*a* with an arc shape. Then, the inventors have found that a predetermined ratio between the curvature of the arc of the slit outlet port 23*a* of the slit passage 23 and the slit length Lt of the arc of the slit outlet port 23*a* prevents the high viscosity paint P, which has been perpendicularly discharged from the slit outlet port 23*a*, from spreading radially to the target surface 40 and widening in the width direction. The slit length Lt is an opening dimension of the slit length L of the slit outlet port 23. In other words, the slit length Lt is the chord length Lt of the arc $b_1b_2$ of the slit outlet port 23*a*. Setting a predetermined ratio between the curvature of the arc of the slit outlet port 23*a* of the slit passage 23 and the slit length Lt of the arc of the slit outlet port 23*a* eliminates or reduces the spread and the widthwise widening of the high viscosity paint P that has been discharged from the slit outlet port 23*a* and is to be applied on the target surface 40. This allows the coat pattern width P to be independent of coating distance h (i.e., gun distance h), discharge quantity and temperature.

According to the experiments, setting the ratio between the curvature radius R of the arc $b_1b_2$ of the slit outlet port 23*a* and the slit length Lt of the slit outlet port 23*a*, namely, the chord length Lt of the chord length $b_1b_2$ of the arc between the end $b_1$ and the end $b_2$ of the slit outlet port 23*a*, at $70 \leq Lt/R \times 100(\%) \leq 130$ prevents the high viscosity paint P, which has discharged from the slit outlet port 23*a* and runs to the target surface 40, from spreading radially and widening in the widthwise direction. Thus, the high viscosity paint P discharged from the slit outlet port 23*a* runs substantially straight.

Figure 6:
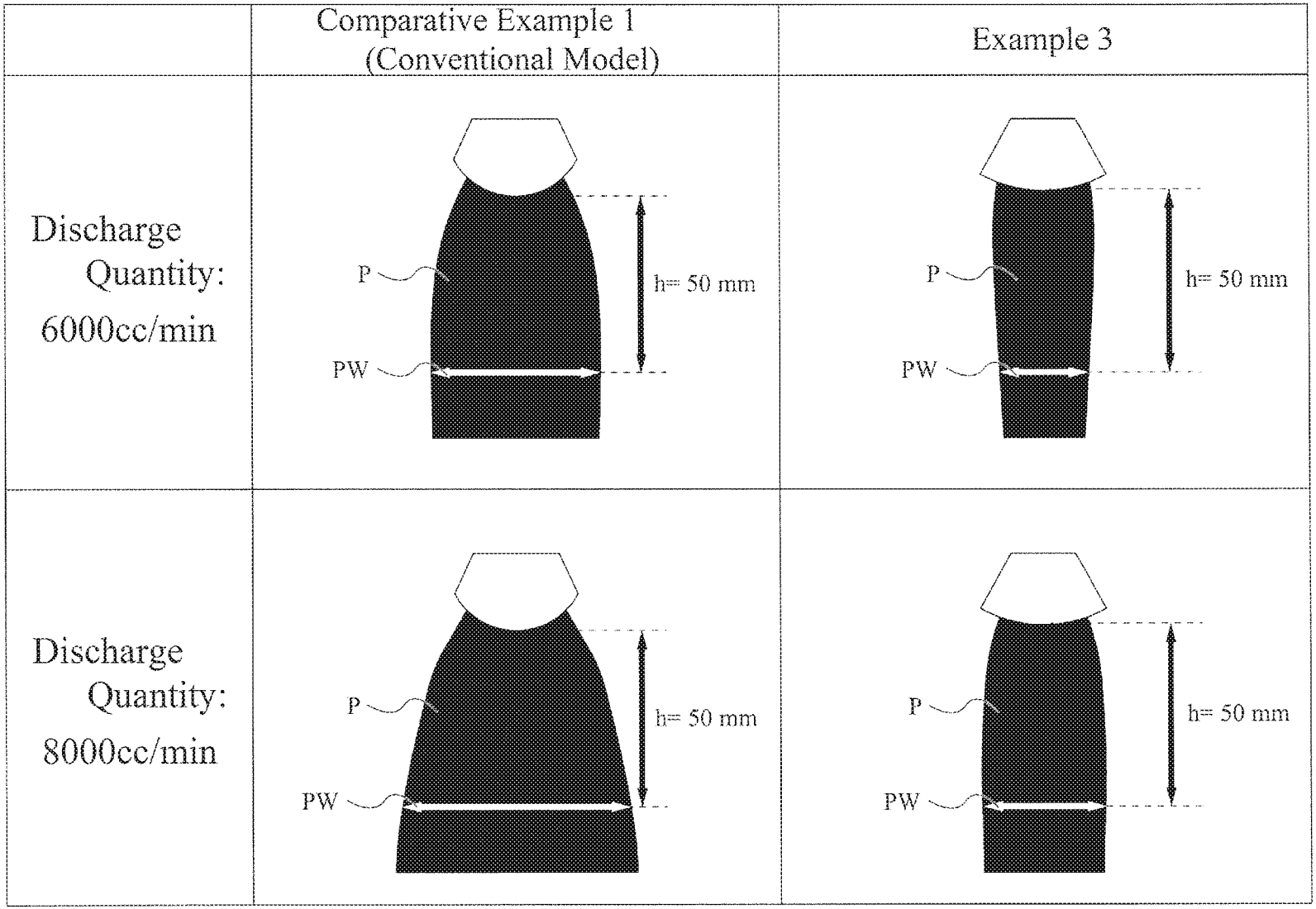
FIG. 6 is a schematic view illustrating the spread of the paint discharged from the coating nozzle according to the example 1 of the present embodiment and the spread of the paint discharged from the coating nozzle according to a comparative example 1 (a conventional model).

As shown in the left of FIG. 6, a conventional coating nozzle sprays the high viscosity paint P on the target surface 40 in such a way that the high viscosity paint P spreads and widens in the widthwise direction; that is, the high viscosity paint P that has been discharged from the slit outlet port 23*a* spreads radially before it reaches to the target surface 40. Thus, the coat pattern width PW according to the conventional coating nozzle is dependent on the pressure and the flow resistance of the high viscosity paint P trough the slit outlet port 23*a*. According to this conventional nozzle, higher pressure or lower viscosity of the high viscosity paint P trough the slit outlet port 23*a* equates with widthwise or radially wider spread of the high viscosity paint P that has been discharged from the slit outlet port 23*a*. In other words, the pressure or the flow resistance of the high viscosity paint P enables the coat pattern width PW to widen. Thus, varying the discharge quantity or the temperature of the high viscosity paint P yields a desired coat patterned width PW. Consequently, the coat pattern width PW greatly varies in accordance with the variation in the discharge quantity, which is controlled by the pressure, the viscosity, which influences the flow resistance, and the temperature of the high viscosity paint P. Additionally, since the high viscosity paint P discharged from the slit outlet port 23*a* spreads far and wide in the widthwise direction, the coat pattern width PW of the coat on the surface 40 greatly varies in accordance with the coating distance h.

In contrast, the slit outlet port 23*a* of the present embodiment has $Lt/R \times 100 = 70\text{-}130\%$ in the relationship between the curvature radius R and the chord length Lt to the arc of the slit outlet port 23*a*. This shape of the slit outlet port 23*a* discharging the high viscosity paint P to the target surface 40 prevents the high viscosity paint P from spreading far and wide in the widthwise direction (referring to the right of FIG. 6). That is, setting the ratio between the curvature radius R and the chord length Lt to the arc of the slit outlet port 23*a* at $Lt/R \times 100 = 70\text{-}130\%$ eliminates or reduces widthwise spread of the high viscosity paint P that has been discharged from the slit outlet port 23*a*. This shape of the slit outlet port 23*a* enables the coat pattern width PW to avoid the effects of the pressure and flow resistance of the high viscosity paint P through the slit outlet port 23*a*. Thus, the coat pattern width PW does not vary with the variation in the discharge quantity, which is controlled by the pressure, the viscosity, which influences the flow resistance, and the temperature of the high viscosity paint P. According to the slit outlet port 23*a* of the present embodiment, the high viscosity paint P that has been discharged from the slit outlet port 23*a* hardly spreads radially and widens in the widthwise direction, and runs substantially straight. Thus, the coating distance h hardly influences the coat pattern width PW. That is, the patterned width PW hardly varies even when the coating distance h varies.

According to the experiments, the high viscosity paint P discharged from the slit outlet port 23*a* that has $Lt/R \times 100(\%) > 130$ in the relationship between the curvature radius R and chord length Lt of the arc $b_1\ b_2$ of the slit outlet port 23*a* spreads far and wide in the widthwise direction. The coat pattern width PW is greatly wider than the slit length Lt. Thus, the viscosity paint P discharged from the slit outlet port 23*a* spreads farther and wider in the widthwise direction as the pressure increased or viscosity decreased. The high viscosity paint P with high pressure or low viscosity yields a wider coat pattern width PW than the viscosity paint P with low pressure or high viscosity. Additionally, since the viscosity paint P discharged from the slit outlet port 23*a* spreads farther and wider in the widthwise direction with an increasing pressure or decreasing viscosity, a longer coating distance h equates with a wider coat pattern width PW.

In contrast, $Lt/R\ 100(\%) < 70$ causes lack of the coat pattern width PW. Thus, it is difficult to yield the coat pattern width PW of 50 to 100 mm. This coat pattern width PW of 50 to 100 mm is preferred from the standpoint of efficiency or productivity. The patterned width PW is more preferably 60 to 90 mm.

Thus, the slit outlet port 23*a* that has $70 \leq Lt/R \times 100(\%) \leq 130$ in the ratio between the curvature radius R and chord length Lt of the arc $b_1b_2$ of the slit outlet port 23*a* prevents the high viscosity paint P from spreading and widening in the widthwise direction while yielding a predetermined coat pattern width PW. The coat pattern width PW hardly widen relative to the slit length Lt. The high viscosity paint P hardly spreads far. Consequently, the coat pattern width PW hardly varies even when the coating distance h varies. Additionally, setting the ratio between the curvature radius R and chord length Lt to the arc of the slit outlet port 23*a* at $70 \leq Lt/R \times 100(\%) \leq 130$ enables the pressure and viscosity of the high viscosity to fail to increase the coat pattern width PW. This yields a predetermined coat pattern width PW regardless of the pressure and viscosity of the high viscosity paint P through the slit outlet port 23*a*. The coat pattern width PW is invariable even when the discharge quantity or the temperature of the high viscosity paint P varies.

According to the experiments, a center angle θ of the arc $b_1b_2$ of the slit outlet port 23*a* is preferably 80 to 110°. With the center angle θ of the arc of the slit outlet port 23*a* less than the values described above, the coat pattern width PW may be short and may not be 50 to 100 mm. Whereas, with the center angle θ of the arc of the slit outlet port 23*a* above the values described above, the high viscosity paint P discharged from the slit outlet port 23*a* may often spread and widen in the widthwise direction and have cracks in patterns. Additionally, for high viscosity paint P with low viscosity, the coat pattern width PW may greatly vary in accordance with the variation in the coating distance h, the discharge quantity, or the temperature of the high viscosity paint P as the high viscosity paint P spreads and widens in the widthwise direction. Setting the center angle θ of the arc of the slit outlet port 23*a* at 80 to 110° yields a predetermined coat pattern width PW and prevents cracks in patterns. Additionally, for the application of the high viscosity paint P having, for example, the viscosity of 0.1 to 1.5 Pa·s/20° C. (which was determined under conditions where the shear rate was 9400 $s^{-1}$/20° C.), the patterned width PW is stably prevented from varying with the gun distance, the discharge quantity or the temperature.

The examples of the coating nozzle 10 according to the present embodiment are more specifically described here.

An example 1 to an example 5 of the coating nozzle 10, and a comparative example 1 and a comparative example 2 of the coating nozzle were fabricated. The example 1 to the example 5, and the comparative example 1 and comparative example 2 are different in the dimensions and shapes of the slit outlet port 23*a*. The experiments on these nozzles in the application of the high viscosity paint P were conducted. The specifications of the examples and the comparative examples are shown in upper of the Table 1.

TABLE 1

| | | | Example 1 | Example 2 | Example 3 | Example 4 | Example 5 | Comparative Example 1 | Comparative Example 2 |
|---|---|---|---|---|---|---|---|---|---|
| Slit Outlet Port 23a | Slit Length L | Lt (mm) | 49 | 49 | 49 | 52 | 62.4 | 43 | 22.6 |
| | | $L_1$ (mm) | 17 | 17 | 17 | 18 | 21.6 | 15 | 7.8 |
| | | $L_2$ (mm) | 16 | 16 | 16 | 17 | 20.4 | 14 | 7.4 |
| | | $L_1$/Lt× 100 (%) | 34.7% | 34.7% | 34.7% | 34.6% | 34.6% | 34.9% | 34.5% |
| | Slit Width W | $W_1$ (mm) | 0.5 | 0.5 | 0.5 | 0.6 | 0.5 | 0.8 | 0.8 |
| | | $W_2$ (mm) | 0.3 | 0.3 | 0.3 | 0.3 | 0.3 | 0.4 | 0.4 |
| | Open Area ($mm^2$) | | 21.3 | 21.3 | 21.3 | 26.1 | 27.12 | 28.8 | 15.12 |
| | Curvature Radius R (mm) | | 40 | 50 | 60.5 | 64.54 | 77.5 | 30 | 15 |
| | Lt/R × 100 (%) | | 122.5% | 98.0% | 81.0% | 80.6% | 80.5% | 143.3% | 150.7% |
| | Central Angle θ (') | | 90 | 90 | 90 | 90 | 90 | 90 | 100 |
| | Desired Coating Pattern in Width (mm) | | 90 | 90 | 60 | 90 | 90 | 90 | 90 |
| Viscosity Of High Viscosity Paint (Shear Velocity: 9400 $s^{-1}$/20° C.) | | | 1.0 Pa · s/ 20° C. | 1.0 Pa · s/ 20° C. | 1.0 Pa · s/ 20° C. | 1.0 Pa · s/ 20° C. | 1.0 Pa · s/ 20° C. | 1.0 Pa · s/ 20° C. | 1.0 Pa · s/ 20° C. |
| Desired Coating Pattern Width PW (mm) | Gun Distance Dependency (Discharge Quantity: 8000 cc/min Gun Speed: 500 mm/s 25° C.) | Gun Distance; 50 mm | 87 | 88 | 60 | 80 | 90 | 86 | 88 |
| | | Gun Distance: 75 mm | 90 | 90 | 62 | 82 | 91 | 90 | 102 |
| | | Gun Distance: 100 mm | 93 | 93 | 63 | 84 | 93 | 95 | Crack |
| | | Difference in Coat Pattern Width PW (mm) | 6 | 5 | 3 | 4 | 3 | 9 | 20 mm ↑ |
| | | Judgement Good: 6 mm or Less | Good | Good | Good | Good | Good | Poor | Poor |
| | Discharge Quantity Dependency (Gun Speed: 500 (mm/s, (Gun Distance: 50 mm 25° C.) | Discharge Quantity: 6000 cc/min | 77 | 78 | 61 | 69 | 81 | 80 | 80 |
| | | Discharge Quantity: 8000 cc/min | 88 | 87 | 68 | 77 | 91 | 93 | 93 |
| | | Discharge Quantity: 10000 cc/min | 94 | 92 | 75 | 82 | 93 | 103 | 105 |
| | | Difference in Coat Pattern With PW (mm) | 17 | 14 | 14 | 13 | 12 | 23 | 25 |
| | | Judgement Good: 20 mm or Less | Good | Good | Good | Good | Good | Poor | Poor |
| | Temperature Dependency (Discharge Quantity: 8000 cc/min. Gun Speed 500 mm/s, Gun Distance 50 mm) | Paint Temperature: 15° C. | 85 | 86 | 66 | 82 | 90 | 87 | 85 |
| | | Paint Temperature: 25° C. | 88 | 87 | 68 | 82 | 91 | 93 | 93 |
| | | Paint Temperature: 35° C. | 90 | 90 | 68 | 84 | 91 | 96 | 99 |
| | | Difference in Coat Pattern With PW (mm) | 5 | 4 | 2 | 2 | 1 | 9 | 14 |
| | | Judgement Good: 5 mm or Less | Good | Good | Good | Good | Good | Poor | Poor |
| Increase in Thickness of Overlap [$(t_2 - t_1)/t_1$ × 100 (%)] (Discharge Quantity: 8000 cc/min, Gun Distance: 50 mm Gun Speed: 500 mm/s, 25° C.) | | | 10 mm(Overlap Width)/+22% | 10 mm/+20% | 10 mm/+19% | 10 mm/+18% | 10 mm/+18% | 10 mm/+30% | 10 mm/+50% |
| | | | 20 mm(Overlap Width)/+25% | 20 mm/+23% | 20 mm/+21% | 20 mm/+20% | 20 mm/+20% | 20 mm/+35% | 20 mm/+60% |

As shown in Table 1, the coating nozzle 10 according to the example 1 to the example 5 has the slit width $W_2$ of 0.3 mm. The slit width $W_2$, which is a minimum width in the slit width W of the slit outlet port 23*a*, is the opening dimension of the slit width W at the widthwise end $b_1$ and end $b_2$ of the slit outlet port 23*a*. Each of the examples 1, 2, 3, and 5 has the slit width $W_1$ of 0.5 mm, and the example 4 has the slit width $W_1$ of 0.6 mm. The slit width $W_1$, which is a maximum width in the slit width W, is the opening dimension of the slit width W at the widthwise middle part 23*aa*.

By the experiments and works, the inventors have found that setting a shear rate of the high viscosity paint P trough the slit outlet port 23*a* at a range from about 5000 to 20000 $s^{-1}$ allows the coat PL to be flat and have a good appearance. The shear rate varies in accordance with the opening dimension of the slit width W, or specifically the width of the slit width W. The discharge quantity of the high viscosity paint P such as damping coat, which is slit-applied on the car body, has conventionally been about 300 to 10000 cc/min. The inventors have examined a preferred opening dimension of the slit width W to provide the high viscosity paint P with a predetermined shear rate and to provide flat coat PL with a good appearance even when the discharge quantity is 8000 cc/min and more. A narrower slit width W equates with a larger shear rate of the high viscosity paint P. Whereas a wider slit width W equates with a smaller shear rate of the high viscosity paint P. Thus, the maximum width $W_1$ of the slit width W is preferably 1.5 to 2.5 times as large as the minimum width $W_2$ of the slit width W. This yields a predetermined shear rate. By the experiments and works, the inventors have found that setting $W_1$=0.5 to 0.6 mm with respect to $W_2$=0.3 mm allows the high viscosity paint P to have a predetermined shear rate and allows the coat PL to be flat and have a good appearance. Thus, a maximum width $W_1$ of the slit width W is set to $W_1$=0.5 mm in the examples 1, 2, 3, and 5, and is set to $W_1$=0.6 mm in the example 4.

By the experiments and works, the inventors have found that a larger ratio of the slit length $L_1$ of the middle part 23*aa* with a fixed slit width W to the slit length Lt of the slit outlet port 23*a* (i.e., the chord length Lt of the arc of the slit outlet port 23*a*) equates with a lager thickness of the overlap D of the coat PL, in which the widthwise ends of the coat lines overlap each other. This coat PL has unevenness. Thus, the ratio of the slit length $L_1$ to the slit length Lt of the slit outlet port 23*a* is preferably $L_1$/Lt×100(%)=33 to 45. Setting 33≤$L_1$/Lt×100(%)≤45 allows for the balance of the slit length $L_1$ between the middle part 23*aa* with a fixed slit width W in a direction parallel to the coating direction and the end part 23*ab* with a variant slit width W in a direction parallel to the coating direction. This yields the coat PL that is substantially flat and the overlap D that has less irregularities regardless of the width d of the overlap D (referring to FIG. 7). The relationship between the slit length $L_1$ and the slit length Lt is more preferably $L_1$/Lt×100(%)=34 to 40.

According to the examples 1 to 5, and the comparative examples 1 and 2, the ratio of the slit length $L_1$ to the slit length Lt in the slit outlet port 23*a* is $L_1$/Lt×100=34 to 35%. The examples 1 to 5, and the comparative examples 1 and 2 are equal in $L_1/L_2$ of the slit length L of the slit outlet port 23*a*.

According to the example 1 to the example 3, the slit length L of the slit outlet port 23*a* is Lt=49 mm, $L_1$=17 mm, and $L_2$=16 mm; the slit open area is 21.3 $mm^2$; the center angle of the arc $b_1b_2$ of the slit outlet port 23*a* is θ=90°. The examples 1 to 3 are only different in the curvature radius R of the arc of the slit outlet port 23*a*. The curvature radius R is 40 mm in the example 1; the curvature radius R is 50 mm in the example 2; the curvature radius R is 60.5 mm in the example 3. Thus, the relation between the curvature radius R and the chord length Lt is Lt/R×100=122.5% in the example 1, Lt/R×100=98.0% in the example 2, and Lt/R×100=81.0% in the example 3.

The coating nozzle 10 of the example 4 has a larger slit length Lt and a larger slit width $W_1$ of the slit outlet port 23*a* than the examples 1 to 3. In addition, the coating nozzle 10 of the example 4 has a larger slit open area than the examples 1 to 3. In the example 4, the slit length L is Lt=52 mm, $L_1$=18 mm, and $L_2$=17 mm; the slit open area is 26.1 $mm^2$; the center angle is θ=90°. The example 4 has a larger curvature radius R of the arc of the slit outlet port 23*a* than the examples 1 to 3. The curvature radius is R=64.54 mm in the example 4. Thus, the example 4 has Lt/R×100=80.6%.

The coating nozzle 10 of the example 5 has a larger slit length Lt and the slit width $W_1$ of the slit outlet port 23*a* than the examples 1 to 4. In addition, the coating nozzle 10 of the example 5 has a larger slit open area than the examples 1 to 4. In the example 5, the slit length L is Lt=62.4 mm, $L_1$=21.6 mm, and $L_2$=20.4 mm; the slit open area is 27.12 $mm^2$; the center angle is θ=90°. The example 5 has a larger curvature radius R of the arc of the slit outlet port 23*a* than the examples 1 to 4. The curvature radius is R=77.5 mm in the example 5. Thus, the example 5 has Lt/R×100=80.5%.

The comparative example 1, which is equivalent to a conventional model, has a larger slit width W and a smaller slit length L than the examples 1 to 5. In the comparative example 1, the slit length L is Lt=43 mm, $L_1$=15 mm, and $L_2$=14 mm; the slit width W is $W_1$=0.8 mm and $W_2$=0.4 mm; the slit open area is 28.8 $mm^2$; the center angle is θ=90°. The comparative example 1 has a smaller curvature radius R of the arc of the slit outlet port 23*a* than the examples 1 to 5. The curvature radius is R=30 mm in the comparative example 1. Thus, the comparative example 1 has Lt/R×100=143.3%.

The comparative example 2, which is equivalent to another conventional model, has a larger slit width W and a much smaller slit length Lt than the comparative example 1. In the comparative example 2, the slit length L is Lt=22.6 mm, $L_1$=7.8 mm, and $L_2$=7.4 mm; the slit width W is $W_1$=0.8 mm and $W_2$=0.4 mm; the slit open area is 15.12 $mm^2$; the center angle is θ=100°. The comparative example 2 has a larger curvature radius R of the arc of the slit outlet port 23*a* than the examples 1 to 5 and the comparative example 1. The curvature radius is R=15 mm in the comparative example 2. Thus, the comparative example 2 has Lt/R×100=150.7%.

Figure 5:
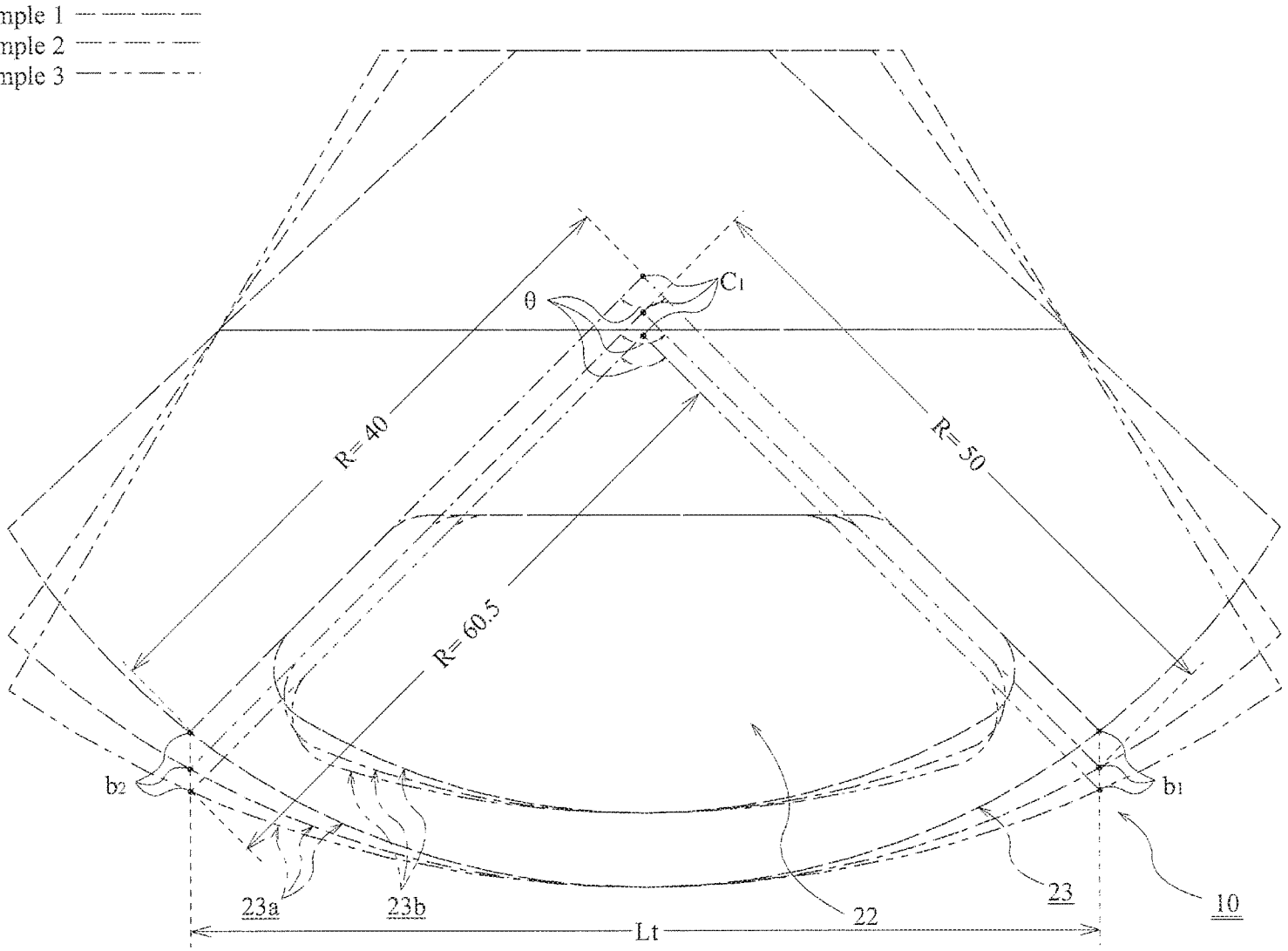
FIG. 5 is a plan view illustrating the main parts of the coating nozzles according to examples 1, 2 and 3 in the present embodiment.

FIG. 5 shows the coating nozzles 10 of the example 1, 2, and 3. These coating nozzles 10 are the same in the length of the slit length Lt (i.e., the chord length Lt of the arc) of the slit outlet port 23*a* and are different in the curvature radius R of the arc of the slit outlet port 23*a*.

In each example and each comparative example, the center $C_1$ of the middle arc of the slit inlet port 23*b* of the slit passage 23 corresponds to the center $C_1$ of the arc of the slit outlet port 23*a* of the slit passage 23. The examples and the comparative examples are substantially the same in the ratio of the curvature radius R of the arc of the slit outlet port 23*a* to the curvature radius of the middle arc of the slit inlet port 23*b*. In other words, the examples and the comparative examples are the same in the length of the widthwise middle of the slit passage 23. For example, the curvature radius of the middle arc of the slit inlet port 23*b* is 0.85 to 0.95 times as large as the curvature radius R of the arc of the slit outlet port 23*a* and the distance between the slit inlet port 23*b* and the slit outlet port 23*a* in the widthwise middle of the slit passage 23 is 3 to 8 mm.

As shown in FIG. 5, the slit length of the slit outlet port 23*a*, or the chord length of the arc of the slit outlet port 23*a* is Lt=49 mm and the central angle of the arc $b_1b_2$ of the slit outlet port 23*a* is θ=90° in the example 1 to the example 3. The curvature radius is R=40 mm in the example 1, the curvature radius is R=50 mm in the example 2 and the curvature radius is R=60.5 mm in the example 3. Thus, the example 1 has the largest curvature of the arc of the slit outlet port 23*a* and the sharpest curve of the example 1 to the example 3. The discharge pressure generated on the slit outlet port 23*a* discharging the high viscosity paint P is, for example, 5 to 25 Pa.

Coating tests of the high viscosity paint P were carried out using the coating nozzle 10 according to the example 1 to the example 5, and the comparative example 1 and the comparative example 2. Specifically, variations in the coat pattern width PW were determined under conditions where coating distance h (which is described as a gun distance h below), discharge quantity and paint temperature were varied. In these tests, damping coat for cars was employed as the high viscosity paint P. This damping coat has viscosity of 1.0 Pa·s/20° C. (under conditions where the shear rate is 9400 $s^{-1}$/20° C.).

In the tests in which the gun distance h was varied, the coat pattern width PW was determined under conditions where the distance h between the target surface 40 and the distal end of the coating nozzle 10 was 50 mm, 75 mm, and 100 mm. Then, the difference in the coat pattern width PW, which was determined under conditions where the distance h between the target surface 40 and the distal end of the coating nozzle 10 was 50 mm, 75 mm, and 100 mm, was determined. In these tests, the discharge quantity was 8000 cc/min, the gun velocity was 500 mm/s, and the paint temperature was 25° C.

When the difference in the coat pattern width PW, which was determined under conditions where the distance h was 50 mm, 75 mm, and 100 mm, is 6 mm or less, the coat pattern width PW is independent of the gun distance and is fixed regardless of the variation in the gun distance h. Thus, an example in which the difference in the coat pattern width PW is 6 mm or less is determined to be good. With 6 mm or less difference, the coat pattern width PW on the surface 40 that may include curved surface or unevenness is fixed. This is achieved without needing to transfer the coating gun G in accordance with the height of the target surface 40. Thus, the coat pattern width PW hardly varies. This is achieved without needing to slightly control the robot to maintain fixed gun distance h. Whereas, with the difference in the coat pattern width PW above 6 mm, the coat pattern width PW would be largely dependent on the gun distance; that is, it greatly varies in accordance with the variation in the gun distance h. Thus, an example in which the difference in the coat pattern width PW was above 6 mm is determined to be poor.

In the tests in which the discharge quantity was varied, the coat pattern width PW was determined under conditions where the discharge quantity was 6000 cc/min, 8000 cc/min, and 10000 cc/min. Then, the difference in the coat pattern width PW, which was determined under conditions where the discharge quantity was 6000 cc/min, 8000 cc/min, and 10000 cc/min, was determined. In these tests, the gun distance h was 50 mm, the gun velocity was 500 mm/s, and the paint temperature was 25° C.

When the difference in the coat pattern width PW, which was determined under conditions where the discharge quantity was 6000 cc/min, 8000 cc/min, and 10000 cc/min, is 20 mm or less, the discharge quantity does not affect the coat pattern width PW; that is, the coat pattern width PW hardly varies and is fixed. Thus, an example in which the difference in the coat pattern width PW is 20 mm or less is determined to be good. Whereas, with the difference in the coat pattern width PW above 20 mm, the coat pattern width PW would be largely dependent on the discharge quantity; that is, it greatly varies in accordance with the discharge quantity. Thus, an example in which the difference in the coat pattern width PW was above 20 is determined to be poor.

In the tests in which the paint temperature was varied, the coat pattern width PW was determined under conditions where the paint temperature was 15° C., 25° C., and 35° C. Then, the difference in the coat pattern width PW, which was determined under conditions where the paint temperature was 15° C., 25° C., and 35° C., was determined. In these tests, the discharge quantity was 8000 cc/min, the gun velocity was 500 mm/s, and the gun distance h was 50 mm.

When the difference in the coat pattern width PW, which was determined under conditions where the paint temperature was 15° C., 25° C., and 35° C., is 5 mm or less, the coat pattern width PW is independent of the temperature. The temperature does not affect the coat pattern width PW and thus the coat pattern width PW hardly varies and is fixed. Thus, an example in which the difference in the coat pattern width PW is 5 mm or less is determined to be good. Whereas, with the difference in the coat pattern width PW above 5 mm, the coat pattern width PW would be largely dependent on the temperature; that is, it greatly varies in accordance with the temperature. Thus, an example in which the difference in the coat pattern width PW is above 5 mm is determined to be poor.

From the point of view of damping, it is preferable to oversupply the high viscosity paint P including damping coat for cars on a target area to eliminate a holiday (a gap in the coat PL), in which the high viscosity paint P is uncoated on the target surface 40. Specifically, the damping coat on the target surface 40 preferably has overlap in which the widthwise ends of the coat lines overlap each other. Unfortunately, increase in the thickness of the overlap at the widthwise ends of the lines of the coat PL may cause the overlap to interfere with peripheral components.

Figure 7:
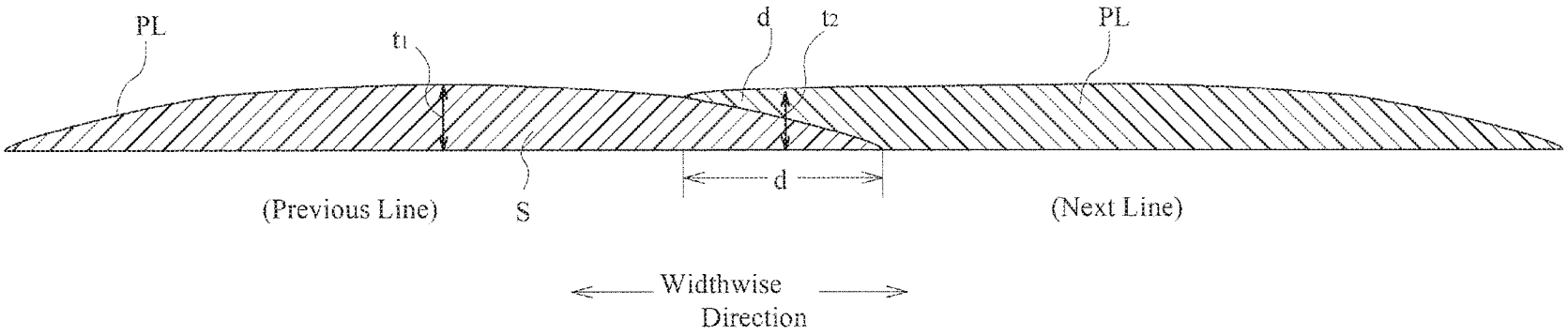
FIG. 7 is a cross-section view of the coat applied by the coating nozzle of the present embodiment. The coat has overlap in which widthwise each end of each line of the coat overlap each other.

Thus, the experiments on overlap of the coat PL was conducted by using the coating nozzle 10 according to the examples 1 to 5, and the comparative examples 1 and 2. In the experiments, a line of the coat PL was overlapped with the other line of the coat PL such that the widthwise ends of the coat lines overlap each other. Specifically, as shown in FIG. 7, the lines of the coat PL were laid to overlap each other so that the widthwise end of the next line of the coat PL was overlaid on the widthwise end of the previous line of the coat PL without spacing. Then, the increase in the coat thickness of the overlap was determined. In the experiments, the width d of the part D (which is described as an overlap D below) in which the widthwise end of the coat PL overlapped each other, was 10 mm or 20 mm. The increase in the thickness $t_2$ of the overlap D of the coat PL relative to the thickness $t_1$ of the middle S of the previous line or the following line of the coat PL was determined by the measurement of the thickness $t_2$ and the thickness $t_1$.

In this test, the discharge quantity was 8000 cc/min, the gun distance was 50 mm, the gun velocity was 500 mm/s, and the paint temperature was 25° C.

The lower column of Table 1 shows the measurements of the coat pattern width PW that is determined under conditions in which the gun distance, the discharge quantity or the paint temperature varies. Additionally, the lower column of Table 1 shows the measurements of the increase in thickness of the overlap with a determined width.

As shown in Table 1, the comparative example 1 and the comparative example 2, which are equivalent to conventional models, have a smaller slit length L of the slit outlet port 23*a* and have a smaller curvature radius R of the arc of the slit outlet port 23*a* than the example 1 to the example 5. Thus, the comparative example 1 and the comparative example 2 have Lt/R×100>130%. According to this comparative example 1 and this comparative example 2, the high viscosity paint P, which has been perpendicularly discharged from the slit outlet port 23*a*, spreads far and wide in widthwise direction. Thus, the increase in the discharge quantity, or the pressure causes the coat pattern width PW to widen. In the comparative example 1 and the comparative example 2, the difference in the coat pattern width PW that was determined under conditions where the discharge quantity was 6000 cc/min, 8000 cc/min, and 10000 cc min was above 20 mm. Thus, the coat pattern width PW greatly varies in accordance with the variation in the discharge quantity. The coat pattern width PW is largely dependent on the discharge quantity.

For these coating nozzles of the comparative example 1 and the comparative example 2, which are equivalent to conventional models, the increase in the discharge quantity causes the coat pattern width PW to widen. Thus, for these coating nozzles, the increase in the pressure, or the discharge quantity of the high viscosity paint P enables the high viscosity paint P that has been discharged from the slit outlet port 23*a* to radially spread farther and wider in the widthwise direction. The increase or decrease in the discharge quantity enables the coat pattern width PW to be controlled.

The nozzle shape that has Lt/R×100>130% according to the comparative example 1 and the comparative example 2 allows the high viscosity paint P that has been discharged from the slit outlet port 23*a* to greatly radiate or greatly widen in the widthwise direction. Thus, the decrease in the flow resistance, or the velocity of the high viscosity paint P causes the coat pattern width PW to greatly widen. That is, the decrease in the velocity caused by a rise in temperature of the paint causes the high viscosity paint P that has been discharged from the slit outlet port 23*a* to spread wider and farther. Thus, the coat pattern width PW greatly widens. According to the comparative examples 1 and 2, the difference in the coat pattern width PW, which was determined under conditions where the paint temperature was 15° C., 25° C., and 35° C., was above 5 mm. According to the comparative examples 1 and 2, the coat pattern width PW greatly varies in accordance with a variation in the paint temperature. That is, the coat pattern width PW is largely dependent on the paint temperature.

The comparative example 1 or 2 that has Lt/R×100>130% causes the high viscosity paint P discharged from the slit outlet port 23*a* to spread radially wider and widen in the widthwise direction as shown in FIG. 6. Thus, the coat pattern width PW greatly varies in accordance with the gun distance h. According to these comparative examples 1 and 2, the difference in the coat pattern width PW, which was determined under conditions where the gun distance h was 50 mm, 75 mm, and 100 mm, was above 6 mm. The longer the gun distance h is, the widthwise wider the spread of the high viscosity paint P discharged from the slit outlet port 23*a* is, that is, the wider the coat pattern width PW is. In particular, the comparative example 2 causes radial spread of the high viscosity paint P to be wider. Thus, the pattern has cracks when the gun distance h is long. In the comparative example 2, the coat pattern width PW greatly varies in accordance with the variation in the gun distance h; that is, the gun distance h has a large influence on the patterned width PW.

Thus, the comparative example 1 or 2 causes the high viscosity paint P discharged from the slit outlet port 23*a* to spread radially and greatly widen. This causes the coat pattern width PW to greatly vary in accordance with the gun distance h. This coat pattern width PW is largely dependent on the distance.

In contrast, the coating nozzle 10 according to the example 1 to the example 5 has the slit shape in which the relationship between the curvature radius R and the chord length Lt to the arc of the slit outlet port 23*a* is 70≤Lt/R×100(%)≤130. This slit shape prevents the high viscosity paint P, which has been perpendicularly discharged from the slit outlet port 23*a*, from spreading far and wider in the width wise direction. That is, the high viscosity paint P discharged from the slit outlet port 23*a* is prevented from spreading and widening in the width wise direction and thus runs substantially straight down as shown in FIG. 6. The slit shape in which the relationship between the curvature radius R and the chord length Lt is 70≤Lt/R×100(%)≤130 prevents the high viscosity paint P discharged from the slit outlet port 23*a* from spreading far and wide. This allows the coat pattern width PW to be independent of the pressure and the flow resistance. The slit shape with Lt/R×100=70 to 130% prevents the high viscosity paint P from spreading and widening in the widthwise direction. This enables the coat pattern width PW to avoid the effects of the pressure and the flow resistance.

Thus, the slit shape of the coating nozzle 10 according to the example 1 to the example 5 has 70≤Lt/R×100(%)≤130 in the relationship between the curvature radius R and the chord length Lt of the arc of the slit outlet port 23*a*. This prevents the high viscosity paint P, which has been discharged from the slit outlet port 23*a*, from spreading and widening. Thus, as shown in FIG. 6, the viscosity paint P discharged from the slit outlet port 23*a* fails to spread and widen even when the discharge quantity of the viscosity paint P increases. This prevents the coat pattern width PW from widening. Thus, the difference in the coat pattern width PW, which was determined under conditions where the discharge quantity was 6000 cc/min, 8000 cc/min, and 10000 cc/min, was 17 mm or less. The coat pattern width PW according to the example 1 to the example 5 hardly varies and is fixed.

The viscosity paint P, which has discharged from the slit outlet port 23*a*, does not spread and widen in the widthwise direction even when the viscosity of high viscosity paint P trough the slit outlet port 23*a* decreases with an increasing temperature. This causes the coat pattern width PW to fail to widen. Thus, the difference in the coat pattern width PW, which was determined under conditions where the temperature was 15° C., 25° C., and 35° C., was 5 mm or less, very small. The coat pattern width PW hardly varies even when the temperature varies. That is, the coat pattern width PW is fixed.

The slit shape with Lt/R×100=70 to 130% prevents the high viscosity paint P, which has been discharged from the slit outlet port 23*a*, from spreading and widening in the widthwise direction and allows the high viscosity paint P to run substantially straight down as shown in FIG. 6. This prevents the coat pattern width PW from varying even when the gun distance h varies. The coat pattern width PW fails to widen even when the gun distance h varies in 50 mm, 75 mm, and 100 mm. Thus, the difference in the coat pattern width PW was 6 mm or less. The coat pattern width PW is fixed.

According to the example 1 to the example 5, a smaller ratio of the chord length Lt to the curvature radius R equates with a smaller variation in the coat pattern width PW, which was determined under conditions where the gun distance h, the discharge quantity or the coat temperature varied. This is because a smaller slit length Lt of the slit outlet port 23*a* equates with a smaller widthwise spread of the high viscosity paint P, which has been discharged from the slit outlet port 23*a*, and a larger curvature radius R of the arc of the slit outlet port 23*a* equates with a smaller curvature of the slit outlet port 23*a*. This prevents the viscosity paint P, which has been discharged from the slit outlet port 23*a*, from spreading far and wide in the widthwise direction. In other words, a smaller ratio of the chord length Lt to the curvature radius R equates with a smaller spread of the viscosity paint P, which has been discharged from the slit outlet port 23*a*. Thus, the viscosity paint P, which has been discharged from the slit outlet port 23*a*, fails to spread wide and far, and runs substantially straight. The viscosity paint P is hardly influenced by the pressure and the flow rate. These are also corroborated by the fact that the example 3, which has a smaller Lt/R than the example 1 and the example 2, has a smaller coat pattern width PW than the example 1 and the example 2. Smaller Lt/R equates with a smaller spread of the viscosity paint P, which has been discharged from the slit outlet port 23*a*, and a straighter discharge pattern of the viscosity paint P. Thus, the coating pattern width PW does not vary in accordance with the gun distance h. Too small Lt/R causes lack of the coat pattern width PW and thus the coat pattern width PW is not 50 to 100 mm, which is preferred from a point view of efficiency and productivity. More preferred coat pattern width PW is 60 to 90 mm. The inventors have seen that the nozzle with $Lt/R\times100\geq70\%$, more preferably, $75\%\leq Lt/R\times100\leq125\%$ yields a predetermined coat pattern width PW.

As can be seen from the example 1 to the example 3, the coat pattern width PW to be easily controlled by changing the ratio of the chord length Lt to the curvature radius R, provided that the coating nozzle 10 has $Lt/R\times100=70\text{-}130\%$. The ratio of the chord length Lt to the curvature radius R in the coating nozzle 10 with $Lt/R\times100=70\text{-}130\%$ determines the desired coat pattern width PW easily.

The coating nozzle 10 of the present embodiment has the slit shape in which the relationship between the curvature radius R and chord length Lt of the arc of the slit outlet port 23*a* is $Lt/R\times100=70\text{-}130\%$. According to this coating nozzle 10 of the present embodiment, varying Lt/R in $Lt/R\times100=70\text{-}130\%$ yields different coating pattern shapes. Thus, selecting one from the slit nozzles that are different in the ratio of the chord length Lt to the curvature radius R in $Lt/R\times100=70\text{-}130\%$ yields a desired coat pattern width PW corresponding to target area or the shape of the target surface 40. Unlike a convention, the coat pattern width PW is not controlled by the discharge quantity. The coat pattern width PW is fixed without depending on fine control in a coating system 50 for controlling the discharge quantity, coating distance h (i.e., gun distance h), and paint temperature to yield a desired patterned width PW. The coating nozzle 10 of the present embodiment does not require the high precision and performance of coating control technique that requires fine control (small unit control) of the discharge quantity, the coating distance h (i.e., gun distance h) and paint temperature. The coating nozzle 10 of the present embodiment enables the control of the discharge quantity and paint temperature, and a coating system 50 for making it constant to be simplified. The coating nozzle 10 of the present embodiment enables a machine including a metering pump providing steady discharge quantity or a heat exchanger needing fine adjustment in the coating system 50 to be simplified. Additionally, a robot does not require fine, detailed, or precision adjustment to make the coating distance h constant, thus enabling complex program input as robot teaching to be simplified.

The coating nozzle 10 of the present embodiment has $Lt/R\times100=70\text{-}130\%$ in the relationship between the curvature R of the arc of the slit outlet port 23*a* and the chord length Lt of the arc of the slit outlet port 23*a*. This prevents the high viscosity paint P, which has been discharged from the slit outlet port 23*a*, from spreading and widening in the widthwise direction. Thus, unlike a convention, the pressure fails to allow the discharge pattern to widen, and the coat pattern width PW is independent of the pressure and the flow resistance. That is, the coat pattern width PW is independent of the discharge quantity, which is controlled by the pressure, and the temperature. The Lt/R of the slit shape determines the desired coat pattern width PW. The high viscosity paint P, which has been discharged from the slit outlet port 23*a*, hardly spreads wide and far, and has substantially straight discharge pattern. Thus, the coat pattern width PW is independent of the gun distance. That is, the coat pattern width PW hardly varies with the variation in the coating distance h, which is distance from the nozzle to the target surface 40. The patterned width PW is unaffected by the coating distance h. The patterned width PW is fixed. This is achieved without needing to move the coating gun in accordance with the height of the target surface 40 including curve or unevenness. This allows the control of the robot, which enables the gun distance h to keep at a constant distance, to be simplified. The coating nozzle 10 of the present embodiment enables the patterned width PW to have less or no variation.

As shown in lower column of Table 1 and FIG. 7, according to the coating nozzle 10 of the comparative example 1, the thickness $t_2$ of the overlap D increased by 30% compared with thickness $t_1$ of the middle S in a previous line or a next line of the coat PL when the coat PL has overlap D of the width d, or the overlap allowance d of 10 mm on each line of the coat. Additionally, according to the coating nozzle 10 of the comparative example 2, the thickness $t_2$ of the overlap D increased by 50% compared with thickness $t_1$ of the middle S of the previous line or the next line of the coat PL. For the width d of 20 mm, the thickness $t_2$ of the overlap D increased by 35% compared with thickness $t_1$ of the middle S of the coat PL according to the coating nozzle 10 of the comparative example 1, and the thickness $t_2$ of the overlap D increased by 60% compared with thickness $t_1$ of the middle S of the coat PL according to the coating nozzle 10 of the comparative example 2.

In contrast, according to the coating nozzles 10 of the example 1 to the example 5, the thickness $t_2$ of the overlap D increased by 22% or less compared with thickness $t_1$ of the middle S of the coat PL when the width d (i.e., the overlap allowance d) of the overlap D was 10 mm. Additionally, the thickness $t_2$ of the overlap D increased by 25% or less compared with thickness $t_1$ of the middle S of the coat PL when the width d of the overlap D was 20 mm. Thus, the coating nozzle 10 according to the example 1 to the example 5 enables the overlap D to have less increase in thickness when the coat PL has overlap between the end of the previous line of the coat and the end of the next line of the coat. Additionally, the overlap D creates less ridge regardless of an overlap width. Thus, the coat PL is uniform in thickness. The coat PL has no possibility of interference in peripheral components when the coat PL has overlap on a protrusion of the surface 40 with unevenness.

The coating nozzle 10 according to the example 1 to the example 5 has the slit outlet port 23*a* in which the slit width W of the widthwise middle 23*aa* is fixed while the slit width W of the end 23*ab* gradually narrows to each end $b_1$ or $b_2$. Thus, the widthwise middle of the slit outlet port 23*a* discharges the paint P thickly while widthwise each end of the slit outlet port 23*a* discharges the paint P thinly. This causes the coat PL to be thinner in the ends than in the middle S. Thus, the overlap in which the widthwise ends of the lines of the coat PL overlap each other is not too thick. Additionally, the coating nozzle 10 according to the example 1 to the example 5 has the slit shape that has Lt/Rx100=70-130% in the relationship between the curvature radius R of the arc of the slit outlet port 23*a* and the chord length Lt of the arc of the slit outlet port 23*a*. This prevents the high viscosity paint P through the slit outlet port 23*a* from widening and spreading in the widthwise direction. This allows the coat PL on the surface 40 to have less unevenness and to be flat. Thus, the coat PL has less variation in the thickness between the overlap D and the middle S regardless of the overlap width. Thus, the overlap D has less increase in the thickness $t_2$ to the thickness $t_2$ of the middle S in the coat PL.

As described above, the coating nozzle 10 of the present embodiment includes the introduction passage 21 which the high viscosity paint P is introduced into, the expansion passage 22 below the introduction passage 21, and the slit passage 23 below the expansion passage 22. The introduction passage 21 has a cylindrical shape extending in the longitudinal direction. The expansion passage 22 communicates with the lower end of the introduction passage 21. The expansion passage 22 is wider in the widthwise direction perpendicular to the coating direction than the opening of the lower end of the introduction passage 21 and has a wider space volume than the introduction passage 21. The expansion passage 22 is substantially sectored trapezoidal. The slit passage 23 communicates with the bottom of the expansion passage 22 and is along in the widthwise direction of the bottom with a wider arc shape of the expansion passage 22. The slit passage 23 is a slit opening that has a smaller width in a direction perpendicular to the widthwise direction, or in the thickness direction of the coating nozzle 10 than the bottom of the expansion passage 22. The slit passage 23 has the slit outlet port 23*a* with an arc shape and the slit inlet port 23*b* with an arc shape. The slit inlet port 23*b* is on the expansion passage 22 and on the opposite side of the slit outlet port 23*b*. The slit inlet port 23*b* introduces the high viscosity paint P whereas the slit outlet port 23*a* discharges the high viscosity paint P. The slit passage 23 widens from the slit inlet port 23*b* to the slit outlet port 23*a*. Thus, the slit passage 23 has a substantially arc shape, or a substantially sectored trapezoid. In this slit passage 23, the relationship between the curvature radius R of the arc $b_1b_2$ of the slit outlet port 23*a* and the chord length Lt (i.e., slit length Lt) of the arc $b_1b_2$ of the slit outlet port 23*a* is Lt/R×100(%)=70-130.

According to the coating nozzle 10 of the present embodiment, the relationship between the curvature radius R of the arc of the slit outlet port 23*a* and the chord length Lt of the arc of the slit outlet port 23*a* is Lt/R×100(%)=70-130. This shape of the slit passage 23 with Lt/R×100(%)=70-130 prevents the high viscosity paint P trough the slit outlet port 23*a* from spreading and widening in the widthwise direction. That is, the shape of the slit passage 23 with Lt/R×100(%)=70-130 eliminates or reduces widthwise spread and widening of the high viscosity paint P that is perpendicularly discharged from the slit outlet port 23*a*. The high viscosity paint P fails to spread radially and runs straight while running from the slit outlet port 23*a* to the target surface 40. Consequently, a coat pattern width PW hardly varies with the coating distance h (i.e., gun distance h).

As described above, the shape of the slit passage 23 in which the relationship between the curvature radius R of the arc of the slit outlet port 23*a* and the chord length Lt of the arc of the slit outlet port 23*a* is Lt/R×100(%)=70-130 prevents the high viscosity paint P trough the slit outlet port 23*a* from spreading and widening. Thus, the coat pattern width PW avoids the effects of the pressure and flow resistance of the high viscosity paint P trough the slit outlet port 23*a*. The shape of the slit passage 23 having Lt/R×100(%)=70-130 prevents or reduces widthwise spread of the high viscosity paint P discharged from the slit outlet port 23*a*. Thus, the coat pattern width PW hardly varies with the discharge quantity controlled by the pressure. Additionally, the coat pattern width PW hardly varies with the paint temperature, or the paint viscosity.

Thus, the coating nozzle 10 according to the present embodiment prevents the coat pattern width PW from varying with the discharge quantity, coating distance, and paint temperature. This coating nozzle 10 yields a fixed coat pattern width PW.

In the coating nozzle 10 of the present embodiment described above, the curvature radius R of the arc $b_1b_2$ of the slit outlet port 23*a* is fixed and the arc of the slit outlet port 23*a* is an arc of a perfect circle. In some embodiments, the arc of the slit outlet port 23*a* may have variant curvature radiuses. For example, the arc of the slit outlet port 23*a* may be an arc of an ellipse, which has a gradual variation in the arc. In this case, the curvature radius R of the arc of the slit outlet port 23*a* is the average of the maximum and the minimum of the variant curvature radiuses. When the average value of the curvature radius as the curvature radius R is predetermined value described above, the coat pattern width PW hardly varies with the temperature, or the viscosity of the high viscosity paint P.

In particular, the central angle θ of the arc $b_1b_2$ of the slit outlet port 23 is 80-100°. This allows the coat pattern width PW to have no excess wide and no cracks. Additionally, the coat pattern width PW hardly varies with the discharge quantity, the coating distance h and the temperature of the paint. The coat pattern width PW has a predetermined width more stably.

The slit passage 23 of the coating nozzle 10 according to the present embodiment described above is offset from the vertical extension of the lower end of the introduction passage 21. Thus, this slit passage 23 has a longer flow passage for the high viscosity paint P than the slit passage that would be located on the vertical extension of the lower end of the introduction passage 21. This allows the high viscosity paint P that flows from the introduction passage 21 to the slit inlet port 23*b* of the slit passage 23 to slowdown, thus enabling a variation in the flow velocity of the high viscosity paint P to be reduced or eliminated. This allows the high viscosity paint P to have homogenized inner pressure and viscosity in the expansion passage 22. Even when the high viscosity paint P from the introduction tube 31 has a variation in characteristics including the pressure distribution, the flow rate, and the viscosity, the coat PL would have less unevenness and have high flatness.

In some embodiments, the slit passage 23 may be located on the central axis trough the introduction passage 21. Alternatively, the slit passage 23 may be out of the central axis trough the introduction passage 21 while the slit passage 23 may be located on the vertical extension of the lower end of the introduction passage 21.

The slit passage 23 of the coating nozzle 10 according to the present embodiment described above widens from the slit inlet port 23*b* to the slit outlet port 23*a*. This causes the paint to spread from the slit inlet port 23*b* to the slit outlet port 23*a*. This yields a predetermined coat pattern width PW, for example, the coat pattern width PW of 50-100 mm. Additionally, the coat PL is thinly discharged from the slit outlet port 23*a* and excessive coating is prevented accordingly. The coating PL is, for example, 25-1000 μm in thickness.

A coating nozzle according to the present embodiment described above has the slit outlet port 23*a* in which the slit width W of the widthwise middle 23*aa* is fixed and the slit width W of the remain gradually decreases from each end of the middle 23*aa* toward each end $b_1$ or end $b_2$. Thus, the widthwise middle of the slit outlet port 23*a* discharges the paint P thickly while each end $b_1$ or end $b_2$ and a region close to the end of the slit outlet port 23*a* discharge the paint P thinly. This prevents increase in the thickness $t_2$ of the overlap D on each end of the lines of the coat PL.

The slit width W of the slit outlet port 23*a* gradually narrows toward each end $b_1$ or end $b_2$. This allows the thickness $t_2$ of the overlap D of the coat PL to be equivalent to the thickness $t_1$ of the middle S of the coat PL that has been discharged from a part with a fixed slit width W in the slit outlet port 23*a* when the coat PL has overlap D of a width d on each end of the coat line. Thus, the coat PL is uniform in thickness. The thickness $t_2$ of the overlap D may be set at the thickness $t_1$ of the middle S or may be a predetermined value.

In particular, the slit shape that has Lt/R×100=70-130% in a relationship between the curvature radius R of the arc of the slit outlet port 23*a* and the chord length Lt of the arc of the slit outlet port 23*a* eliminates or reduces widening and spread of the paint P through the slit outlet port 23*a* from. This allows the coat PL on the target surface 40 to have less unevenness and to be flat. When the lines of coat PL overlap each other by a width d of 10-20 mm, the coat PL has less difference in thickness between the overlap D and the middle S. Thus, the coat PL is more uniform in thickness.

The coating nozzle 10 according to the preset embodiment described above is formed of the body 11 and the lid 12, which is distinguished from the body 11. The body 11 is formed of the outer member 11A and the inner member 11B, which is distinguished from the outer member 11A. These outer member 11A, inner member 11B and lid 12 are integrally fixed with four embedded screws 28.

The coating nozzle 10 according to the preset embodiment described above includes the slit passage 23 defined by the inner member 11B and the lid 12. If something blocks the slit passage 23 to affect the coating pattern, separating the inner member 11B and the lid 12 allows clogs in the slit passage 23 to be eliminated. This coating nozzle 10 is easy to maintenance and stably yields the predetermined pattern width.

The wall defining the slit passage 23 often wears thin since the slit passage 23 is slit-shaped opening discharging the high viscosity paint P thinly. The coating nozzle 10 according to the preset embodiment described above has three layers including the outer member 11A, the inner member 11B, and the lid 12. The outer member 11A and the inner member 11B, which are distinguished each other, form the body 11. The inner member 11B and the lid 12 define the slit passage 23. If the inner walls defining the slit passage 23 wears thin, it is only required that the inner member 11B and the lid 12 are exchanged. Thus, the maintenance of the coating nozzle 10 needs low cost. The inner member 11B and the lid 12 may be composed of materials with high wear resistance while the outer member 11A may be composed of cheaper materials. This allows the coating nozzle 10 to be produced at low cost.

In some embodiments, the coating nozzle 10 may be formed of one member. Alternatively, the coating nozzle 10 may be formed of two members, the body 11 and the lid 12. These body 11 and lid 12 may define the slit passage 23. Separating the inner member 11B and the lid 12 allows clogs in the slit passage 23 to be eliminated. This enables the coating nozzle 10 to be easy to maintenance. In some embodiments, the introduction passage 21, the expansion passage 22 and the slit passage 23 may be flush each other and each may be formed into symmetry. This allows the coating nozzle 10 to be easy to manufacture.

The coating nozzle 10 according to the preset embodiment is used for coating paint on car bodies. However, the application of the coating nozzle 10 is not limited to cars. For example, the coating nozzle 10 may be used for coating paint for trains, ships or buildings. In the slit coating using the coating nozzle 10 of the preset embodiment, the sprayed paint is not mist but film. This prevents splashing and overflowing of the coat PL on the surface 40. The high viscosity paint P may be a damping coat or a chipping resistance coat, which is used as, for example, an undercoat or sealer that is applied to an underfloor or a wheelhouse of cars.

The present invention is not limited to above mentioned embodiment with respect to a structure, a shape, quantity, a material, a size, a connecting relationship, or assembly of other members of the coating nozzle 10. In addition, not all of the numeric values described in the present embodiment indicate a critical value, and a certain numeric value indicates an appropriate value for the embodiment. Some embodiments include any other value.

The invention claimed is:

1. A coating nozzle, comprising:

at least one member having an introduction passage for introducing paint, an expansion passage, and a slit passage inside the coating nozzle, the expansion passage communicating with a lower end of the introduction passage and widening in a widthwise direction being perpendicular to a coating direction, the expansion passage having a wider space volume than the introduction passage, the slit passage communicating with a bottom of the expansion passage, the slit passage being a slit opening having a smaller width being perpendicular to the widthwise direction than the bottom of the expansion passage, the slit passage having a slit inlet port on a first side and a slit outlet port with an arc shape on a second side, the slit inlet port introducing the paint from the expansion passage, the slit outlet port discharging the paint, wherein the slit passage has Lt/R×100=70-130% in which a curvature radius of the arc of the slit outlet port is R and a chord length of the arc of the slit outlet port is Lt, to reduce widthwise spread of paint emitted from the coating nozzle.

2. A coating nozzle according to claim 1, wherein the at least one member comprises a plurality of members being assembled, and two members of the plurality of members define the slit passage.

3. A coating nozzle as in claim 1, wherein the slit passage is offset from a vertical extension of the lower end of the introduction passage.

4. A coating nozzle as in claim 1, wherein the arc of the slit outlet port has a central angle of 80-100°.

5. A coating nozzle as in claim 1, wherein the slit passage widens from the slit inlet port to the slit outlet port in the widthwise direction.

6. A coating nozzle as in claim 1, wherein the slit outlet port comprises a widthwise middle and both sides out of the widthwise middle, the widthwise middle having a fixed width in a direction perpendicular to the widthwise direction, each of the both sides decreasing in the width gradually toward a widthwise end of the slit outlet port.

* * * * *